US009377748B2

(12) United States Patent
Goto et al.

(10) Patent No.: US 9,377,748 B2
(45) Date of Patent: Jun. 28, 2016

(54) IMAGE FORMING APPARATUS

(71) Applicant: CANON KABUSHIKI KAISHA, Tokyo (JP)

(72) Inventors: Joji Goto, Susono (JP); Chikara Imaizumi, Numazu (JP); Kazushi Suzuki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/694,870

(22) Filed: Apr. 23, 2015

(65) Prior Publication Data

US 2015/0307307 A1 Oct. 29, 2015

(30) Foreign Application Priority Data

Apr. 25, 2014 (JP) ..... 2014-091957
Dec. 25, 2014 (JP) ..... 2014-262503

(51) Int. Cl.
*G03G 21/16* (2006.01)
*B65H 43/00* (2006.01)
*B65H 85/00* (2006.01)

(52) U.S. Cl.
CPC ..... *G03G 21/1623* (2013.01); *B65H 43/00* (2013.01); *B65H 85/00* (2013.01); *B65H 2402/31* (2013.01); *B65H 2402/441* (2013.01); *B65H 2402/45* (2013.01); *B65H 2404/1421* (2013.01); *B65H 2404/1521* (2013.01); *B65H 2404/1532* (2013.01); *B65H 2511/20* (2013.01); *B65H 2511/417* (2013.01); *B65H 2801/06* (2013.01)

(58) Field of Classification Search
None
See application file for complete search history.

(56) References Cited

U.S. PATENT DOCUMENTS

2001/0051059 A1* 12/2001 Morikami ..... G03G 15/0194 399/121

FOREIGN PATENT DOCUMENTS

| | | | | | |
|---|---|---|---|---|---|
| JP | 3-131871 | A | | 6/1991 | |
| JP | 4-84147 | A | | 3/1992 | |
| JP | 7-232467 | A | | 9/1995 | |
| JP | 11-296009 | A | | 10/1999 | |
| JP | H11-296009 | A | * | 10/1999 | ..... G03G 15/20 |
| JP | 2007-127902 | A | | 5/2007 | |
| JP | 2007-127902 | A | * | 5/2007 | ..... G03G 21/16 |
| JP | 2009-145623 | A | | 7/2009 | |

* cited by examiner

*Primary Examiner* — Clayton E Laballe
*Assistant Examiner* — Jas Sanghera
(74) *Attorney, Agent, or Firm* — Canon USA, Inc., IP Division

(57) ABSTRACT

In a case where a belt unit is not attached to an apparatus body, when an opening and closing member is closed against the apparatus body, a switching member cannot press a switch, and image formation operation is prohibited. In a case where the belt unit is attached to the apparatus body, when the opening and closing member is closed against the apparatus body, the switching member presses the switch, and the prohibition of the image formation is released.

25 Claims, 19 Drawing Sheets

IMAGE FORMING APPARATUS

BACKGROUND OF THE INVENTION

1. Field of the Invention

The present invention relates to electro-photographic image forming apparatuses capable of mounting a belt unit that contacts a recording material and forming an image on the recording material.

2. Description of the Related Art

In electro-photographic image forming apparatuses (laser beam printers, copying machines, facsimile apparatuses, and the like), some image forming apparatus bodies include an opening and closing member to enable attachment of a unit to the inside of the body for replacement or maintenance of the unit.

Japanese Patent Application Laid-Open No. 2009-145623 discusses a structure for enabling attachment of a belt unit including an intermediate transfer belt to a body.

However, in such a structure in which the belt unit can be attached to the body, in a state where the belt unit is not attached to the body, if an image is formed onto a recording material, the following problem may occur. That is, when the belt unit is not attached to the body, at the position at which the recording material and the belt contact, since the recording material cannot be conveyed with the belt, the recording material is not properly conveyed, and this may cause a jam.

SUMMARY OF THE INVENTION

The present invention is directed to a simple structure for prohibiting image forming operation in a state where a belt unit is not attached to a body.

According to an aspect of the present invention, an image forming apparatus configured to form an image onto a recording material includes a belt unit having a belt contacting the recording material, an opening and closing member openable and closable against an apparatus body, a switch configured to switch a state where image formation operation is prohibited and a state where the prohibition is released, and a switching member capable of pressing the switch, the switching member being provided on the opening and closing member. The image formation operation prohibited state is switched by pressing the switch and releasing the pressing by the switching member, the pressing of the switch by the switching member is released and the image formation operation is prohibited when the opening and closing member is opened against the apparatus body, and the belt unit can be detached and attached to the apparatus body. In a case where the belt unit is not attached to the apparatus body, when the opening and closing member is closed against the apparatus body, the switching member cannot press the switch and the image formation operation is prohibited, and in a case where the belt unit is attached to the apparatus body, when the opening and closing member is closed against the apparatus body, the switching member presses the switch and the prohibition of the image formation operation is released.

According to another aspect of the present invention, an image forming apparatus configured to form an image onto a recording material includes a belt unit having a belt contacting the recording material, and an opening and closing member openable and closable against an apparatus body. When the opening and closing member is opened against the apparatus body, the belt unit can be detached and attached to the apparatus body. When the belt unit is not attached to the apparatus body, the opening and closing member is prevented from being completely closed against the apparatus body, and when the belt unit is attached to the apparatus body, the opening and closing member can be completely closed against the apparatus body.

According to yet another aspect of the present invention, an image forming apparatus configured to form an image onto a recording material includes a belt unit having a belt contacting the recording material, an opening and closing member openable and closable against an apparatus body, in which when the opening and closing member is opened against the apparatus body, the belt unit can be detached and attached to the apparatus body, and a regulation member configured to prevent the belt unit attached to the apparatus body from being detached from the apparatus body, the regulation member being able to move to a regulating position for preventing the belt unit from being detached from the apparatus body, and to a regulated position where the belt unit can be detached from the apparatus body. The regulation member positioned at the regulated position prevents the opening and closing member from being closed against the apparatus body.

Further features of the present invention will become apparent from the following description of exemplary embodiments with reference to the attached drawings.

DESCRIPTION OF THE EMBODIMENTS

Figure 10:
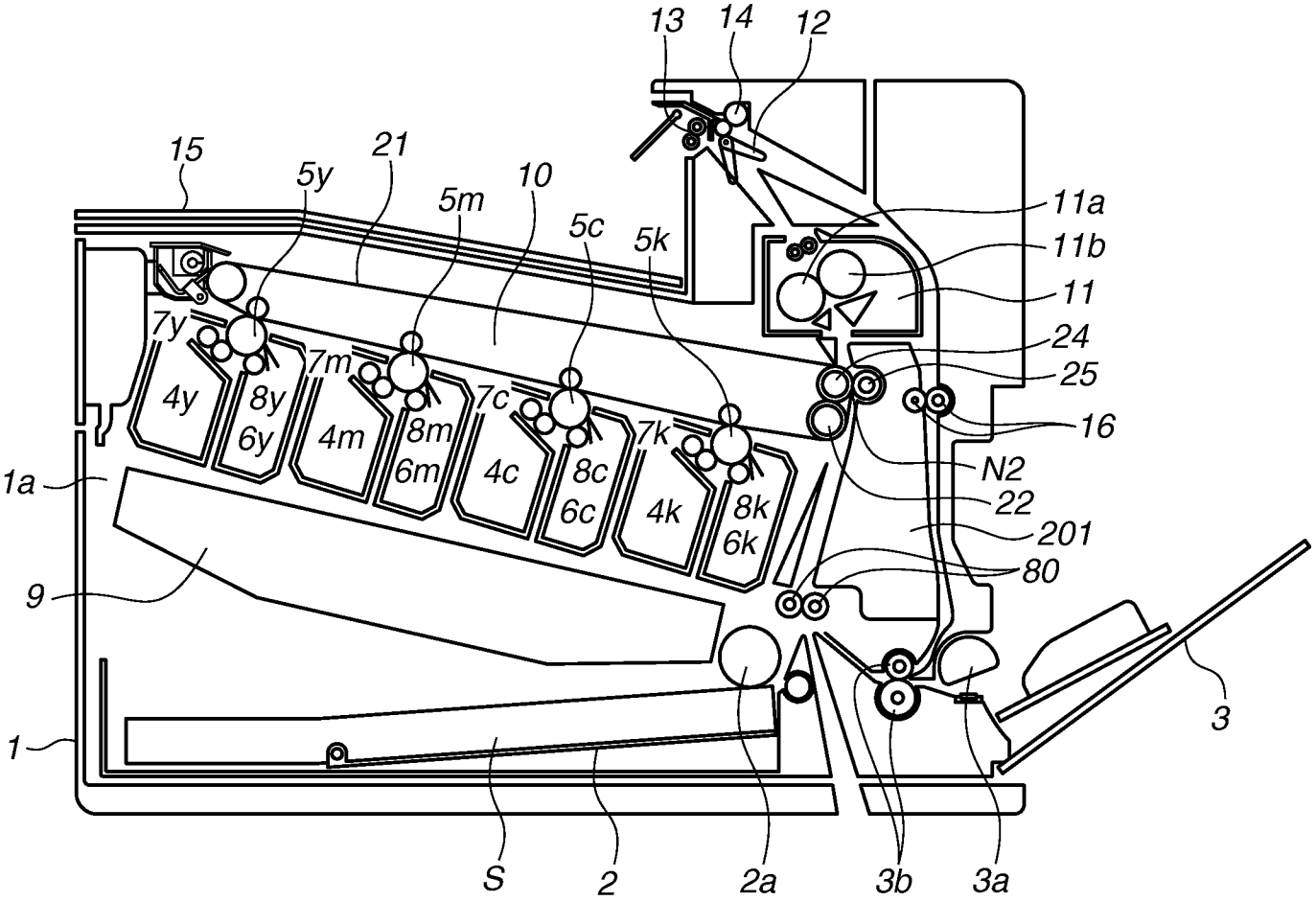
FIG. 10 is a schematic cross-sectional view illustrating the printer.

An image forming apparatus 1 according to the first exemplary embodiment is described. The image forming apparatus 1 is an electrophotographic 4-drum type full-color laser beam printer (hereinafter, referred to as printer 1). FIG. 10 is a cross-sectional view illustrating an overall structure of the printer 1.

[Image Forming Apparatus]

At a lower part of an apparatus body 1*a* of the printer 1, a cassette 2 for stacking and storing a sheet S, which is a recording material such as paper, is set in a state where the cassette can be pulled out. At the right side of the apparatus in FIG. 10, a manual sheet feeding section 3 for stacking the sheet (for example, paper) S is provided. For the cassette 2 and the manual sheet feeding section 3, conveyance rollers 2*a* and 3*a*, and a conveyance roller pair 3*b* that are driven and rotated by individual motors (not illustrated) are provided to feed (convey) the sheets S one by one to a registration roller pair 80. The registration roller pair 80 is used to convey the sheets S, and driven and rotated by a motor (not illustrated). The printer 1 includes, as a serially aligned image forming section, process cartridges 4*y*, 4*m*, 4*c*, and 4*k* (cartridges 4) of yellow, magenta, cyan, and black, respectively. The process cartridge 4 includes photosensitive drums 5*y*, 5*m*, 5*c*, and 5*k* (photosensitive members 5), which are image bearing members, and charging rollers 6*y*, 6*m*, 6*c*, and 6*k* (charging units 6) for uniformly negatively charging the surface of the photosensitive member 5. The process cartridge 4 further includes development rollers 7*y*, 7*m*, 7*c*, and 7*k* (development units 7) for making toner adhere to electrostatic latent images and developing the images as toner images, and blades 8*y*, 8*m*, 8*c*, and 8*k* (photosensitive member cleaning units 8) for removing residual toner remaining on the photosensitive member 5. A scanner unit (exposure unit) 9 for emitting laser beams according to image information to form an electrostatic latent image onto the photosensitive drum 5 is provided below the process cartridge 4. An intermediate transfer unit 10 having an intermediate transfer belt 21 is provided above the process cartridge 4. The intermediate transfer unit 10 is described in detail below. The photosensitive member 5, the charging unit 6, and the development unit 7 are driven by motors (not illustrated).

[Image Formation Operation]

Next, the image formation operation in the printer 1 is described. While the photosensitive drum 5 is driven and rotated, the surface of each photosensitive drum 5 is charged to a predetermined potential by the charging unit 6 to which charging voltage is applied, and a desired electrostatic latent image is formed by an exposure unit. Further, toner attaches to the electrostatic latent image with the development unit 7 to which development voltage is applied. Then, a toner image is formed on the surface of each photosensitive drum 5. The primary transfer of the toner images formed on the individual photosensitive drums 5 onto the intermediate transfer belt 21 is performed to form an overlapped four-color full-color toner image, and the toner image moves to a secondary transfer nip N2 by the movement of the surface of the intermediate transfer belt 21. To the secondary transfer nip N2, the sheet S is conveyed at an appropriate timing for the toner image on the intermediate transfer belt 21 by the registration roller pair 80. At the secondary transfer nip N2, while the intermediate transfer belt 21 and the sheet S come in contact with each other, the toner image is transferred from the intermediate transfer belt 21 onto the sheet S. The sheet S passes through between a heating rotator 11*a* and a pressing rotator 11*b* of a fixing device 11 for fixing, and thereby the toner image is fixed. The heating rotator 11*a* and the pressing rotator 11*b* are driven and rotated by a motor (not illustrated). The outer surface of the heating rotator 11*a* is heated to a high temperature by a heater (not illustrated) disposed inside. Then, the conveyance path carrying the sheet S is switched, depending on a one-sided print job or a two-sided print job, by a two-sided flapper 12.

In the case of a one-sided print job for forming an image on only one side of the sheet S, the sheet S is conveyed by a discharge roller pair 13, and discharged onto a sheet stacking portion 15. In the case of a two-sided print job for forming images on both sides of the sheet S, the sheet S is reversed by a switchback roller pair 14, and conveyed to a two-sided conveyance path. On the two-sided conveyance path, the sheet S is conveyed by a conveyance roller pair 16, passes through the secondary transfer nip N2 again by the conveyance roller pair 3*b* and the registration roller pair 80, the toner image is transferred onto the sheet S, and the sheet S passes through the fixing device 11 and is discharged by the discharge roller pair 13 onto the sheet stacking portion 15. The discharge roller pair 13, the switchback roller 14, and the conveyance roller pair 16 are driven and rotated by motors (not illustrated).

[Intermediate Transfer Unit]

Figure 2:
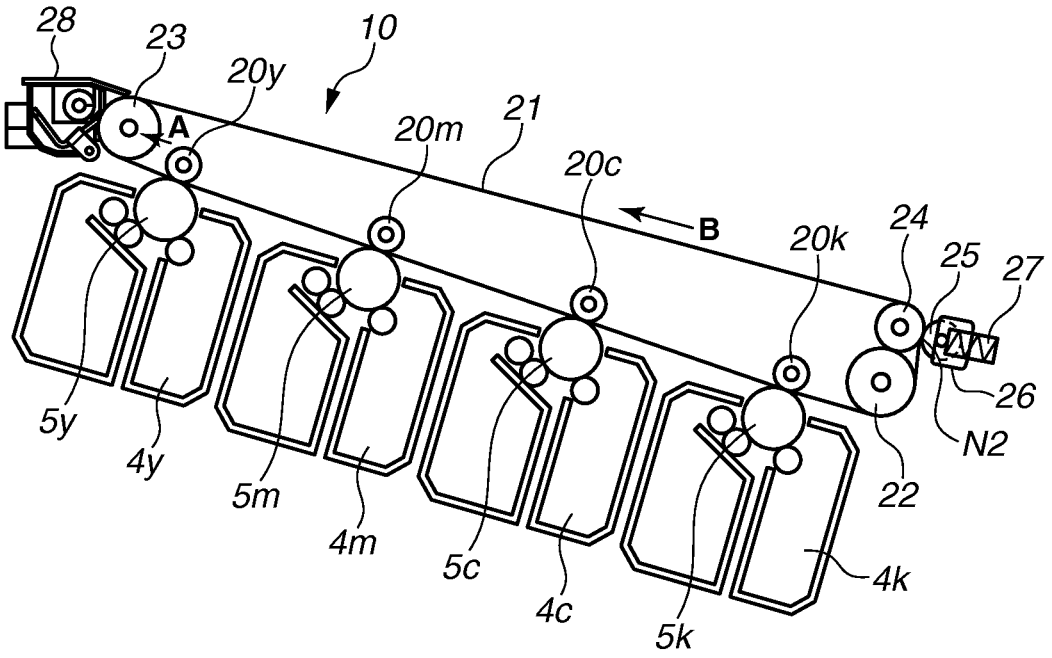
FIG. 2 is a cross-sectional view illustrating an intermediate transfer unit in in full-color image formation in a printer.

With reference to FIG. 2, the intermediate transfer unit 10 is described in detail. FIG. 2 is a cross-sectional view illustrating the intermediate transfer unit 10 in in full-color image formation in the printer 1.

The intermediate transfer unit 10 is a belt unit including the intermediate transfer belt 21, primary transfer rollers 20 (20*y*, 20*m*, 20*c*, and 20*k*) placed opposite to the individual photosensitive members 5, a drive roller 22, a tension roller 23, a secondary transfer counter roller 24, and a cleaning unit 28. The intermediate transfer belt 21 is a cylindrical endless belt stretched by the drive roller 22, the tension roller 23, the secondary transfer counter roller 24, and the primary transfer roller 20. The tension roller 23 is urged by an urging member (not illustrated) in the arrow A direction illustrated in FIG. 2 to apply a predetermined tension to the intermediate transfer belt 21. The drive roller 22 is driven and rotated by a motor (not illustrated) provided in the body 1*a*, and thereby the intermediate transfer belt 21 rotates in the arrow B direction illustrated in FIG. 2 at a predetermined speed.

The primary transfer is performed in a primary transfer section formed by the primary transfer roller 20 and the photosensitive drums 5. In the primary transfer section, a positive bias voltage (primary transfer voltage) is applied to the primary transfer roller 20, and using a potential difference between the surface of the negatively charged photosensitive drum 5 and the primary transfer roller 20, toner transfer onto the intermediate transfer belt 21 is performed.

The secondary transfer is performed in the secondary transfer nip N2 formed by the secondary transfer counter roller 24 and a secondary transfer roller 25. The secondary transfer roller 25 is rotatably held by bearings 26 at both end portions. The secondary transfer roller 25 presses the secondary transfer counter roller 24 through the intermediate transfer belt 21 by a spring 27, and thereby the secondary transfer nip N2 is formed. In the secondary transfer nip N2, to form a transfer electric field onto a sheet that does not easily conduct electricity such as paper, a relatively high transfer bias voltage (secondary transfer voltage) is applied to the secondary transfer roller 25. If there is a small air gap in the secondary transfer nip N2, anomalous discharge may occur, and it is necessary to provide better contact between the sheet and the secondary transfer roller 25, which is a transfer bias application member. For this purpose, generally, the spring 27, which is an urging member of the secondary transfer roller 25, is set to have a relatively strong force. In this exemplary embodiment, the force to the spring 27 is set to 50 N.

A cleaning unit 28 removes toner that has not been transferred onto the sheet in the secondary transfer nip N2 and remaining on the intermediate transfer belt 21. The cleaning unit 28 is disposed, relative to the rotation direction (arrow B direction illustrated in FIG. 2) of the intermediate transfer belt 21, at an upstream position of the primary transfer unit formed by the photosensitive drum 5*y* and the primary transfer roller 21*y*, and a downstream position of the secondary transfer nip N2. The toner removed by the cleaning unit 28 is conveyed to a toner collection container (not illustrated) provided in the body 1*a*, and stored.

Figure 3:
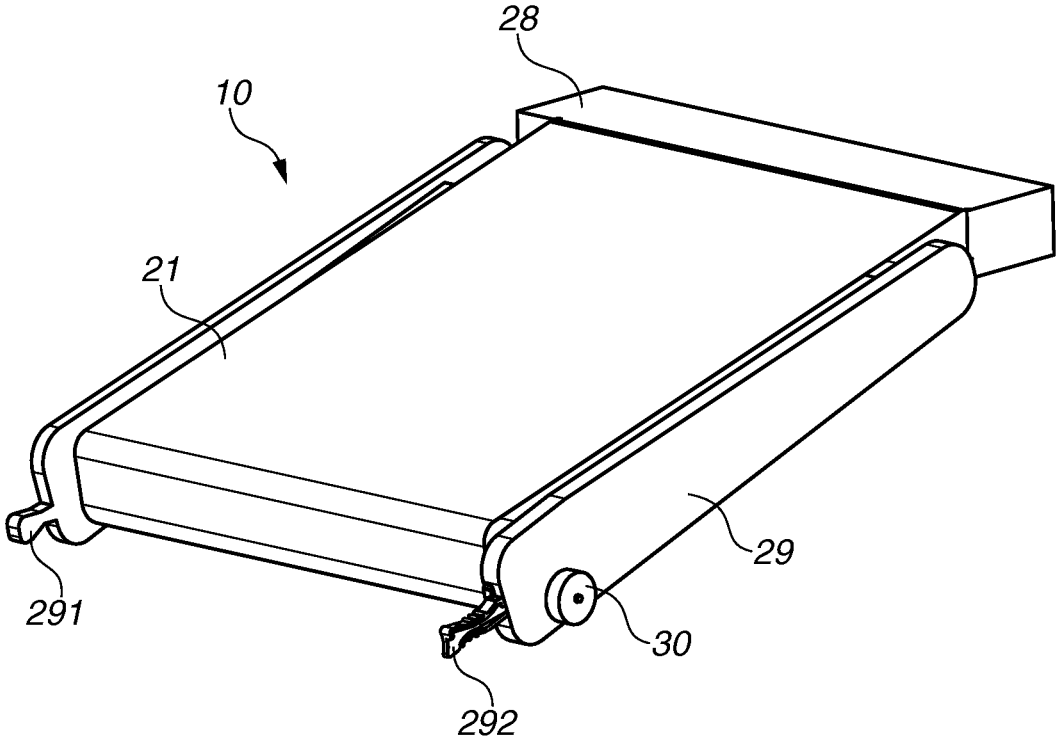
FIG. 3 is a perspective view illustrating an intermediate transfer unit.

FIG. 3 is a perspective view illustrating an appearance of the intermediate transfer unit. The intermediate transfer unit 10 includes the intermediate transfer belt 21, a frame 29, the cleaning unit 28, and a drive coupling 30. The intermediate transfer unit 10 can be attached and detached to and from the body 1*a*. The frame 29 holds the above-described primary transfer roller 20, drive roller 22, tension roller 23, and secondary transfer counter roller 24. The drive coupling 30 is fixed at an end portion of the drive roller 22, and protrudes from the frame 29. The drive coupling 30 engages with a drive coupling (not illustrated) provided in the body 1*a* and the driving force from a motor (not illustrated) of the body 1*a* is transmitted, and thereby the drive coupling 30 is driven and rotated. The frame 29 includes two handles (holding portions) 291 and 292 to be held by a user when the user attaches or detaches the intermediate transfer unit 10 to or from the body 1*a* from outside in the width direction of the intermediate transfer belt 21.

[Interlock Mechanism]

Figure 4A:
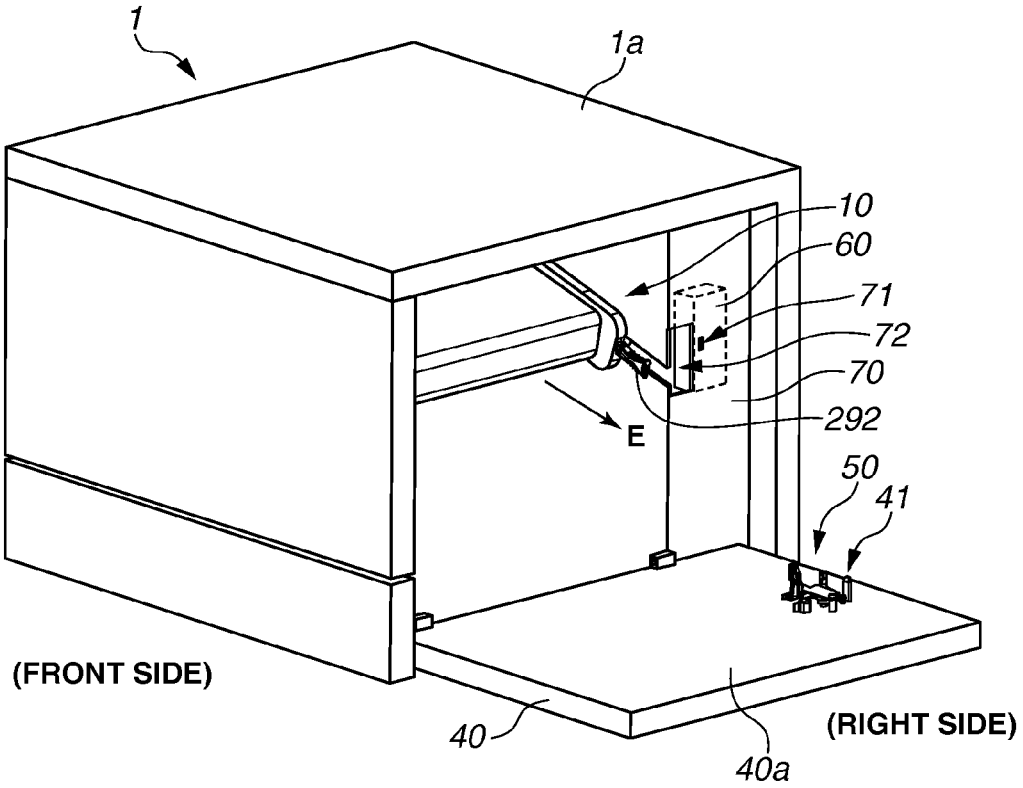
FIG. 4A is a perspective view illustrating a printer with a right door open.

FIG. 4A is a perspective view illustrating the printer 1 in a state where the intermediate transfer unit 10 is attached to the inside of the body 1*a* and a right door 40 is open. The right door 40 provided on the right side (see FIG. 4A) viewed from the front side (see FIG. 4A) of the body 1*a* includes a level rotation shaft at a lower part of the body 1*a*. The right door 40 is an opening and closing member that can rotate about the rotation shaft, and open or close against the body 1*a*. When the right door 40 is open, the intermediate transfer unit 10 attached to the body 1*a* and the handles 291 and 292 appear, and the user can hold and pull the handles to detach the intermediate transfer unit 10 from the body 1*a*.

The printer 1 includes an interlock mechanism 60 at the right rear of the body 1*a*. The interlock mechanism 60 includes a switch 61 (see FIG. 4B), and is held by an inner cover member 70 fixed to the body 1*a*. The inner cover member 70 is a part of the frame member of the body 1*a*, and disposed inwardly in the body 1*a* from the right door 40. The inner cover member 70 includes a first opening 71 and a second opening 72, which is different from the first opening 71. The first opening 71 is provided to insert a switching member 41 into the body 1*a*, to a position deeper than the inner cover member 70. The second opening 72 is provided, when the intermediate transfer unit 10 is attached to the body 1*a*, to prevent a contact portion 512 of a moving member 51, which is described below, from interfering with the inner cover member 70.

Figure 4B:
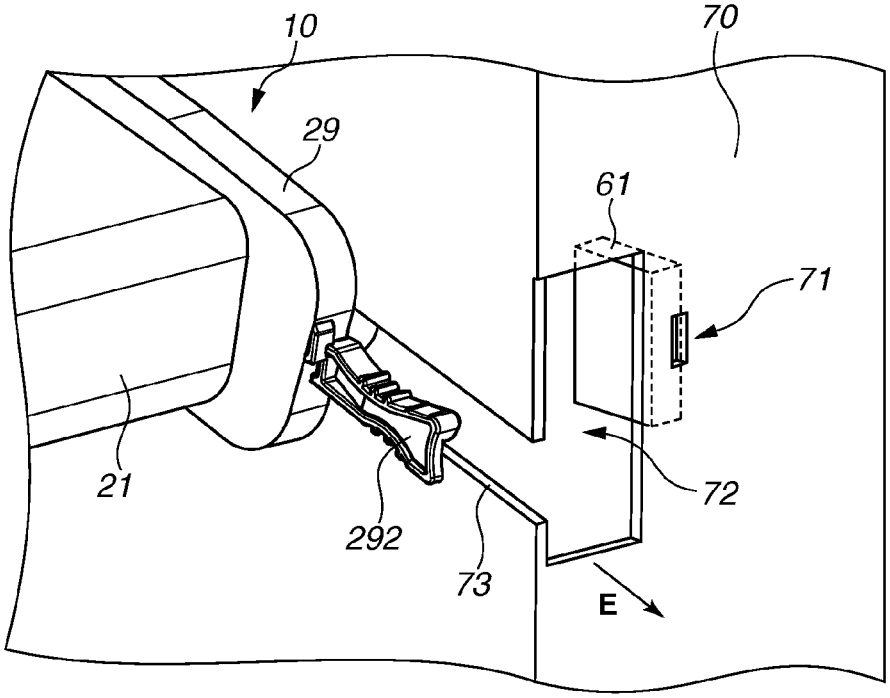
FIG. 4B is an enlarged view illustrating first and second openings in the perspective view illustrating the printer with the right door open.

FIG. 4B is an enlarged view illustrating the first and second openings 71 and 72 in the perspective view in FIG. 4A. In a state where the right door 40 is closed against the body 1*a*, the switching member 41 provided on the right door 40 is inserted into the first opening 71 to press the switch 61 provided in the interlock mechanism 60, and thereby the switch is turned on (energized state). When the right door 40 is open, the switching member 41 is removed from the first opening 71, and separated from the switch 61, and thereby the pressing is released. Then, the switch 61 is turned off (non-energized state).

Figure 11:
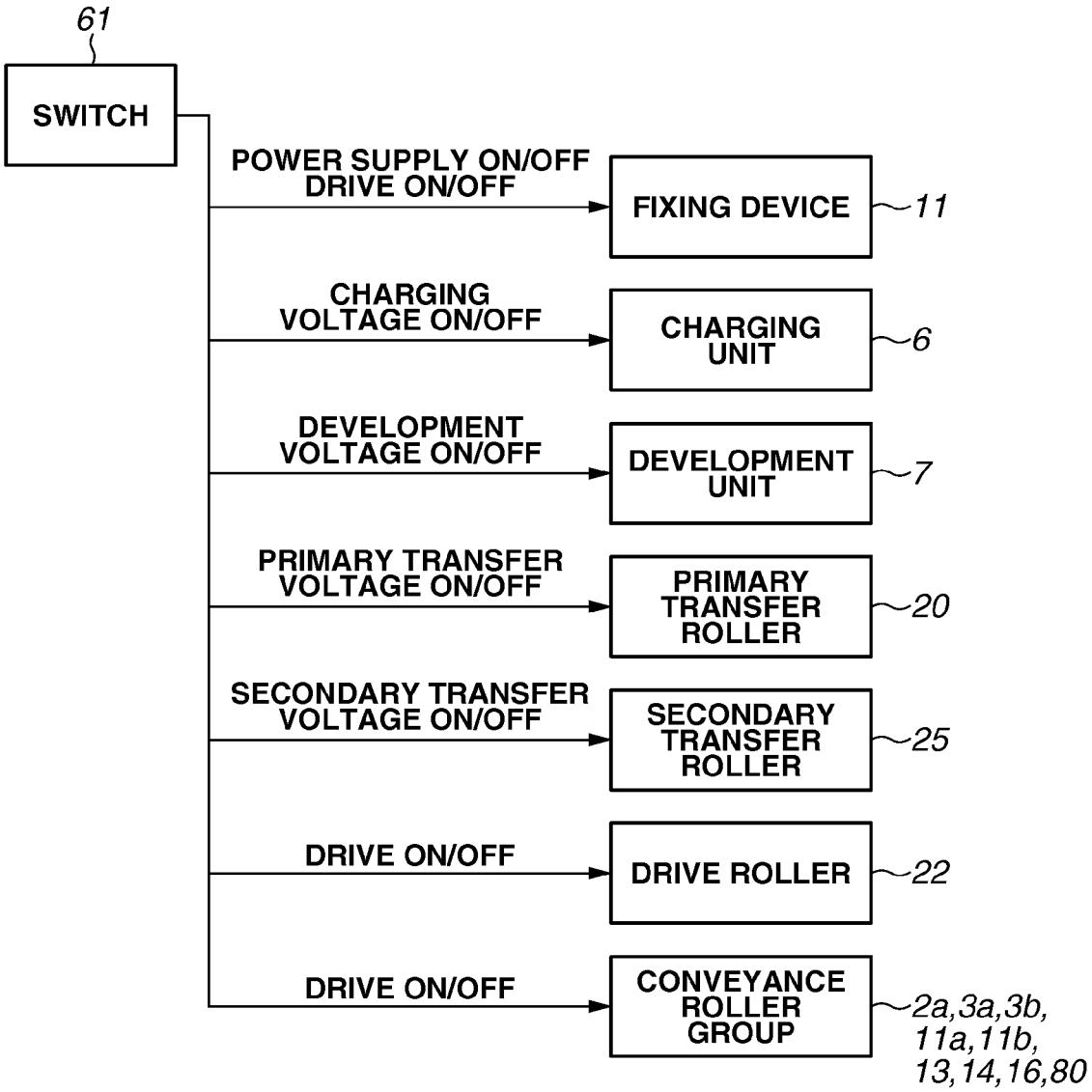
FIG. 11 is a block diagram illustrating a control configuration with a switch.

FIG. 11 is a block diagram illustrating a control configuration with the switch 61 of the interlock mechanism 60. When the switch 61 is turned off, a circuit provided in the interlock mechanism 60 is shut off. This stops the motors for driving and rotating the drive roller 22, and the conveyance roller group (2*a*, 3*a*, 3*b*, 11*a*, 11*b*, 13, 14, 16, and 80) for conveying the sheet S. Further, the bias voltage power supply from a power source (not illustrated) provided in the body 1*a* to the charging unit 6, the development unit 7, the primary transfer roller 20, and the secondary transfer roller 25, and the power supply to the heater in the fixing device 11 is also stopped. The body 1*a* includes a switch (not illustrated) different from the switch 61. By this switch, when the right door 40 is opened, the drive and rotation of the photosensitive member 5, the charging unit 6, and the development unit 7 is stopped. As described above, the state where the switch 61 is turned off means a state where the image formation operation (print operation) is prohibited. When the right door 40 is closed, the switching member 41 turns on the switch 61 and the switch (not illustrated), and thereby the prohibition of the image formation operation (print operation) is released, and the image formation operation can be performed. As described above, the pressing operation and the pressing releasing operation of the switch 61 of the switching member 41 switches the image formation operation prohibited state (prohibition or prohibition release).

[Attachment and Detachment of Intermediate Transfer Unit 10]

As illustrated in FIG. 10, at a position closer to the center of the printer 1 than the right door 40, a secondary transfer frame 201 is provided as an opening and closing member capable of rotating to open or close, other than the right door 40. The secondary transfer frame 201 holds the secondary transfer roller 25.

When the right door 40 is opened, the secondary transfer frame 201 is opened in conjunction with the opening operation, and when the right door 40 is closed, the secondary transfer frame 201 also is closed. From a state where the right door 40 and the secondary transfer frame 201 are opened, only the secondary transfer frame 201 can be closed.

In a state where the right door 40 is opened against the body 1*a*, the user can pull out the intermediate transfer unit 10 in the E direction in FIG. 4 while holding the above-described handles 291 and 292 to remove the intermediate transfer unit 10 from the body 1*a* to the outside. While being pulled out, the intermediate transfer unit 10 is guided by a guide rail 73. In the state where the right door 40 is opened against the body 1*a*, by inserting the intermediate transfer unit 10 into the body 1*a* in the reverse direction of the E direction while the intermediate transfer unit 10 is being guided by the guide rail 73, the intermediate transfer unit 10 can be attached to the body 1*a*. This structure enables replacement and maintenance of the intermediate transfer unit 10.

In such a structure where the intermediate transfer unit 10 can be attached and detached to and from the body 1*a*, if the right door 40 is closed in a state where the intermediate transfer unit is not attached to the body 1*a*, the following cases are assumed. If the right door 40 is closed and the switch 61 is turned on, the prohibition of the image formation operation is released, and the conveyance roller group enters a state where the rollers can be driven. In such a state, even if an image is formed, no image can be transferred onto the sheet S. Further, since it is impossible to convey the sheet S by the intermediate transfer belt 21 at the position at which the sheet S and the intermediate transfer belt 21 are expected to come in contact with each other, a jam such as a sheet jam occurs, and this may cause a failure.

To solve the problem, a method of detecting whether the intermediate transfer unit 10 is attached to the body 1*a*, and not forming an image if the intermediate transfer unit 10 is not attached can be provided. As a method, a dedicated sensor for detecting whether the intermediate transfer unit 10 is attached to the body 1*a* can be provided, however, the cost increases to provide the sensor, and the size of the body increases to provide a space for disposing the sensor.

As another method, whether the intermediate transfer unit 10 is attached to the body 1*a* can be detected by temporarily operating a drive unit (not illustrated) for driving the intermediate transfer unit 10 provided in the body 1*a*. Specifically, based on whether there is a response (for example, a signal output) from the intermediate transfer unit 10 side when the driving unit is operated in a state where the intermediate transfer unit 10 is attached to the body 1*a*, whether the intermediate transfer unit 10 is attached to the body 1*a* or not can be detected. In such a case, the sensor for detecting whether the intermediate transfer unit 10 is attached to the body 1*a* can be eliminated, however, it is necessary to temporarily operate the drive unit for driving the intermediate transfer unit 10. Consequently, it takes time to notify the user that the intermediate transfer unit 10 is not attached to the body 1*a*.

To solve the problem, in this exemplary embodiment, a structure in which the right door 40 is not completely closed when the intermediate transfer unit 10 is not attached to the body 1*a* is provided to prevent the switch 61 from being turned on. Specifically, an interference mechanism 50 is provided on the inner surface 40*a* side of the right door 40. The inner surface 40*a* of the right door 40 is, in the surfaces of the right door 40, a surface opposite to (facing) the inside of the body 1*a*.

[Interference Mechanism 50]

Figure 1A:
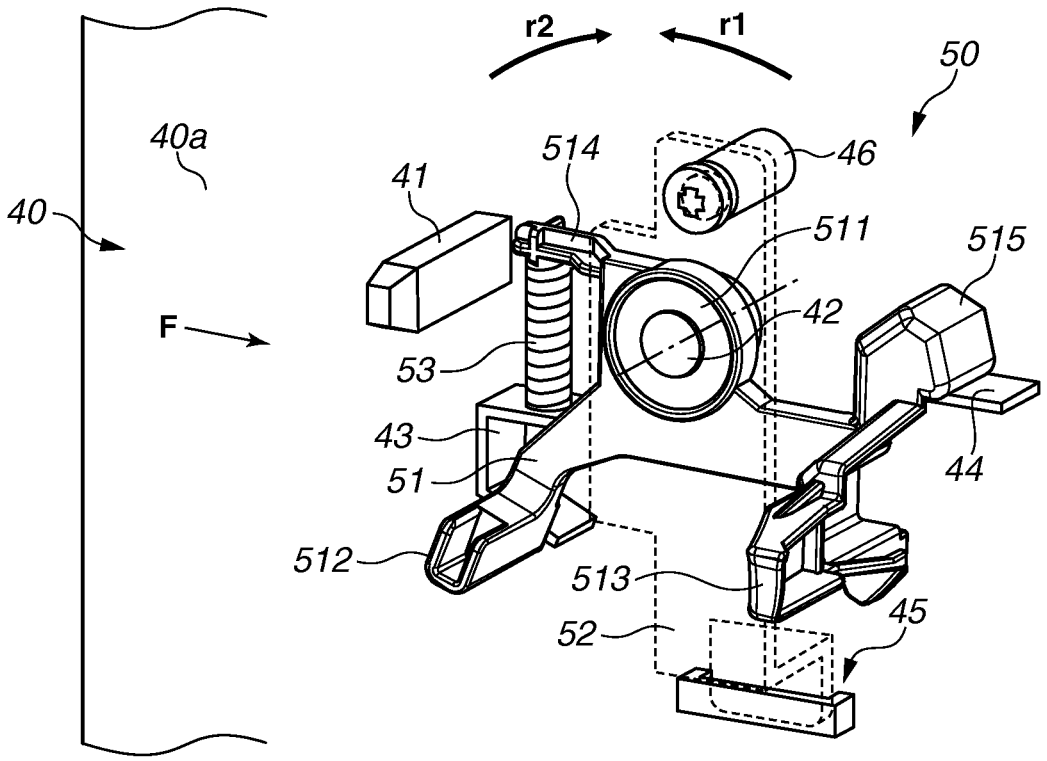
FIG. 1A is a perspective view illustrating an interference mechanism.
Figure 1B:
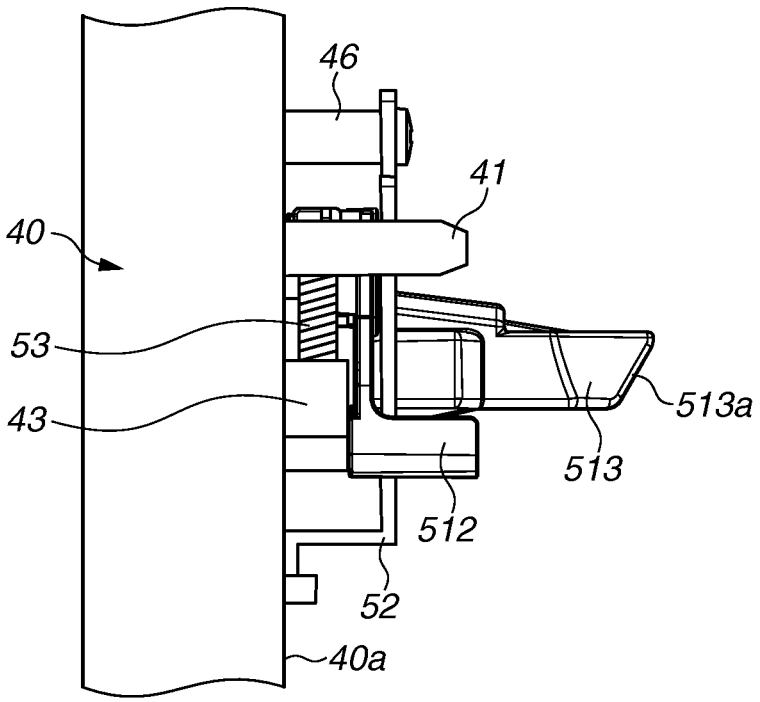
FIG. 1B illustrates the interference mechanism viewed from the back of the body (F direction in FIG. 1A).

FIG. 1A is a perspective view illustrating the interference mechanism 50 provided on the right door 40. FIG. 1B illustrates the interference mechanism 50 viewed from the back (F direction in FIG. 1A) of the body 1*a*. The interference mechanism 50 in FIG. 1A includes the moving member 51 that changes its orientation depending on whether the intermediate transfer unit 10 is attached in a closing operation of the right door 40, a fixing member 52 (broken line in FIG. 1A) for fixing the moving member 51, and a compression spring 53 for urging the moving member 51 in a direction. The interference mechanism 50 prevents, when the intermediate transfer unit 10 is not attached to the body 1*a*, the right door 40 from being completely closed (completely door-closed state).

Figure 9:
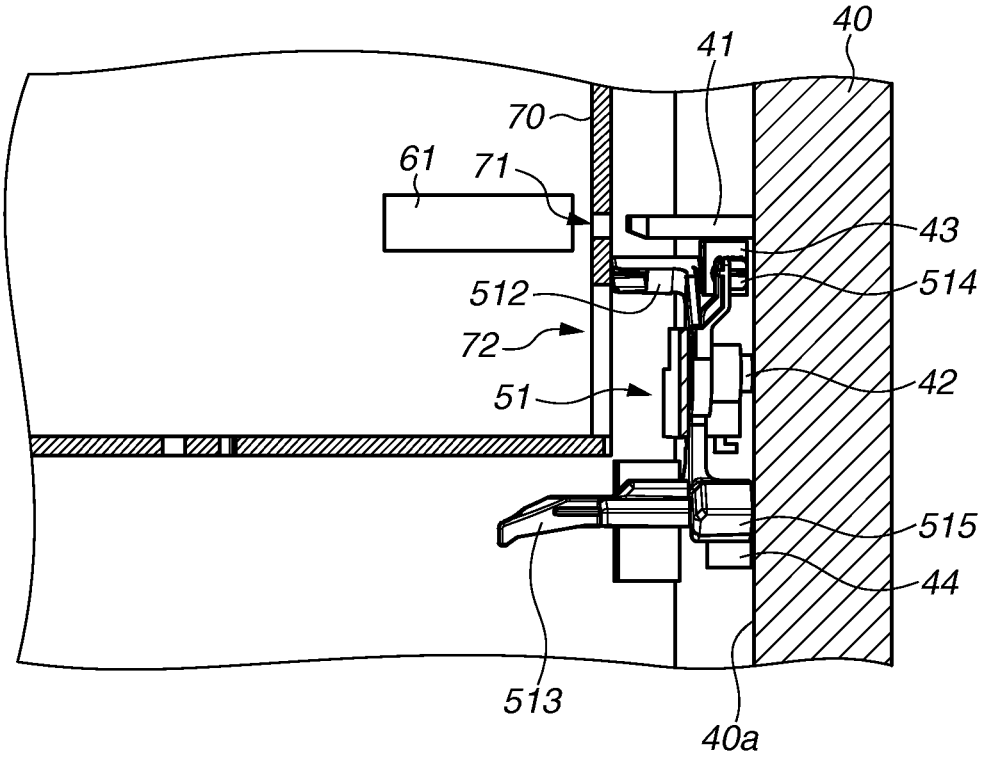
FIG. 9 illustrates the moving member viewed from above the printer in a state where the right door is prevented from becoming the completely closed state.

The moving member 51 includes a hole portion 511, a contact portion 512, an intermediate transfer unit contact portion 513, a spring supporting portion 514, and a rotation stopping portion 515. In the moving member 51, to a rotation shaft 42 protruding from the inner surface 40*a* of the right door 40 to the body 1*a* side, the hole portion 511 fits, and thereby the moving member 51 is pivotally supported in a state rotatable about the rotation shaft 42 against the right door 40. The contact portion 512 is provided in the moving member 51, and the contact portion 512 is a protruding portion extending to the body 1*a* side and perpendicularly to the inner surface 40*a* of the right door 40. The contact portion 512 has a shape for preventing the right door 40 from being completely closed by interposing between an inner cover member 70 and a rib 43 of the right door 40 (As illustrated in FIG. 9 (to be described hereinafter)) when the right door 40 is closed in a state where the intermediate transfer unit 10 is not attached to the body 1*a* (detached state). The intermediate transfer unit contact portion 513 is provided in the moving member 51, and the intermediate transfer unit contact portion 513 is a protruding portion extending to the body 1*a* side and perpendicularly to the inner surface 40*a* of the right door 40. A tip 513*a* of the intermediate transfer unit contact portion 513 includes an inclined plane extending in an obliquely right downward direction viewed from the front side of the body 1*a*.

Figure 5A:
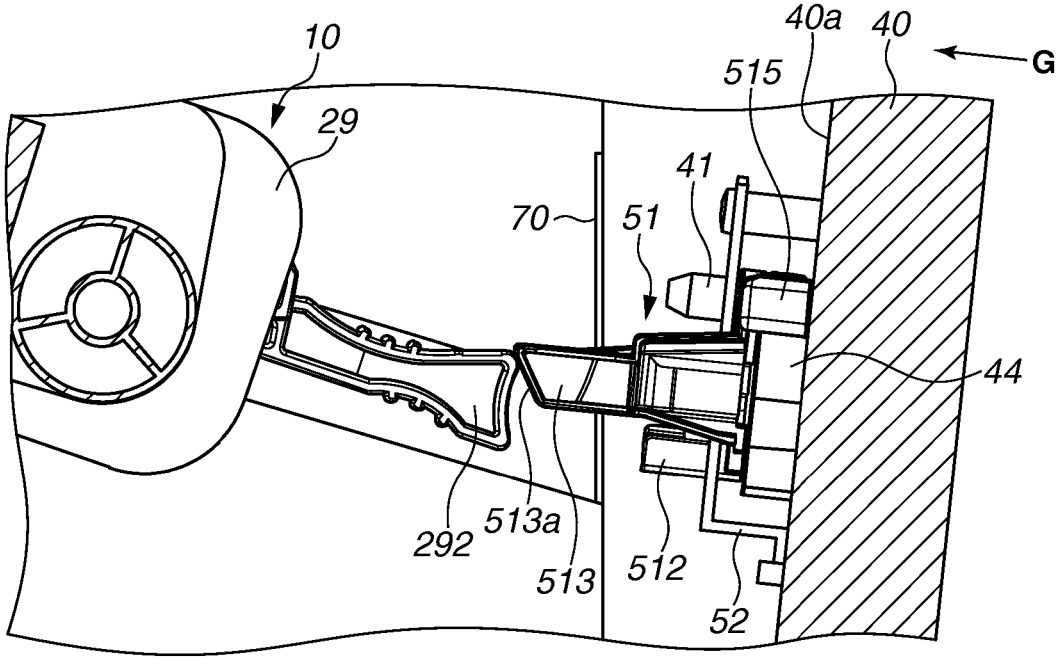
FIG. 5A illustrates a handle of the intermediate transfer unit and a moving member viewed from the front side of the printer.
Figure 5B:
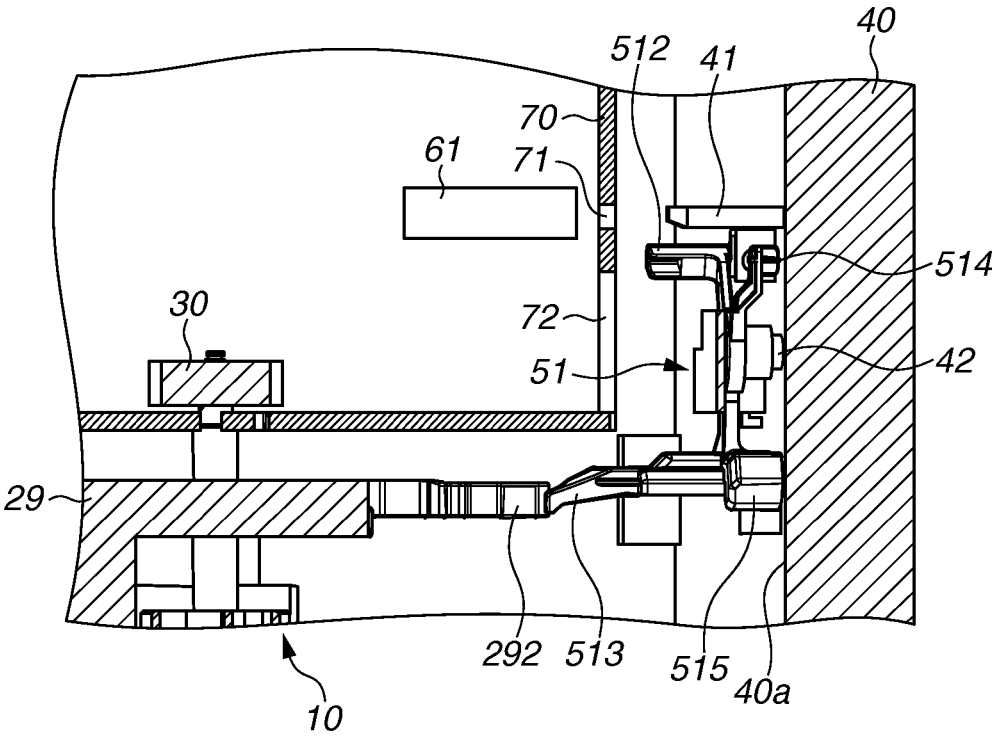
FIG. 5B illustrates the handle of the intermediate transfer unit and the moving member viewed from above the printer.

The intermediate transfer unit contact portion 513, in a state where the intermediate transfer unit 10 is attached to the body 1*a*, when the right door 40 is closed, comes in contact with the handle 292 provided on the frame 29 of the intermediate transfer unit 10. As illustrated in FIGS. 5A and 5B (to be described hereinafter), when the intermediate transfer unit contact portion 513 contacts the handle 292, the intermediate transfer unit contact portion 513 receives a moment for turning the moving member 51 in the counterclockwise direction (r1 direction) viewed from the inner side of the body 1*a*. The spring supporting member 514 supports the compression spring 53, which is described below. The spring supporting member 514 receives a force in the clockwise direction (r2 direction) from the compression spring 53 viewed from the inner side of the body 1*a*. The rotation stopping portion 515, when the intermediate transfer unit contact portion 513 does not contact the handle 292, comes in contact with a rib 44 protruding from the inner surface 40*a* of the right door 40. This stops the rotation of the moving member 51 by the moment from the compression spring 53. The fixing member 52 is a plate-like member, and one end of the fixing member 52 is inserted into a groove 45 provided on the right door 40. The other end portion is fastened with a screw to an annular boss 46 protruding from the inner surface 40*a* of the right door 40. The plane between the both ends regulates the movement of the moving member 51 in the axis direction (the direction perpendicular to the inner surface 40*a* of the right door 40) of the rotation shaft 42. The compression spring 53 is provided between the rib 43 perpendicularly provided from the inner surface 40*a* of the right door 40 and the spring supporting portion 514 of the moving member 51. The compression spring 53 applies a moment in the clockwise direction (r2 direction) to the moving member 51 when the moving member 51 is viewed from the inner side of the body 1*a*.

[Operation of Interference Mechanism 50]

The operation of the interference mechanism 50 is described.

(1) A Case where the Intermediate Transfer Unit 10 is Attached to the Body 1*a*

Figure 6A:
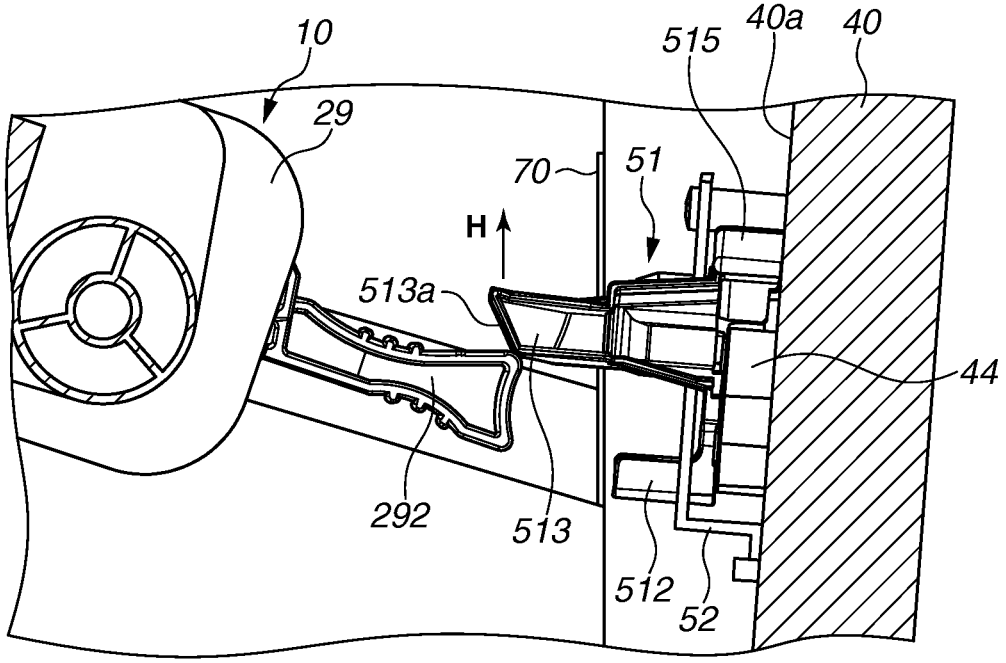
FIG. 6A illustrates the handle of the intermediate transfer unit and the moving member viewed from the front side of the printer.
Figure 6B:
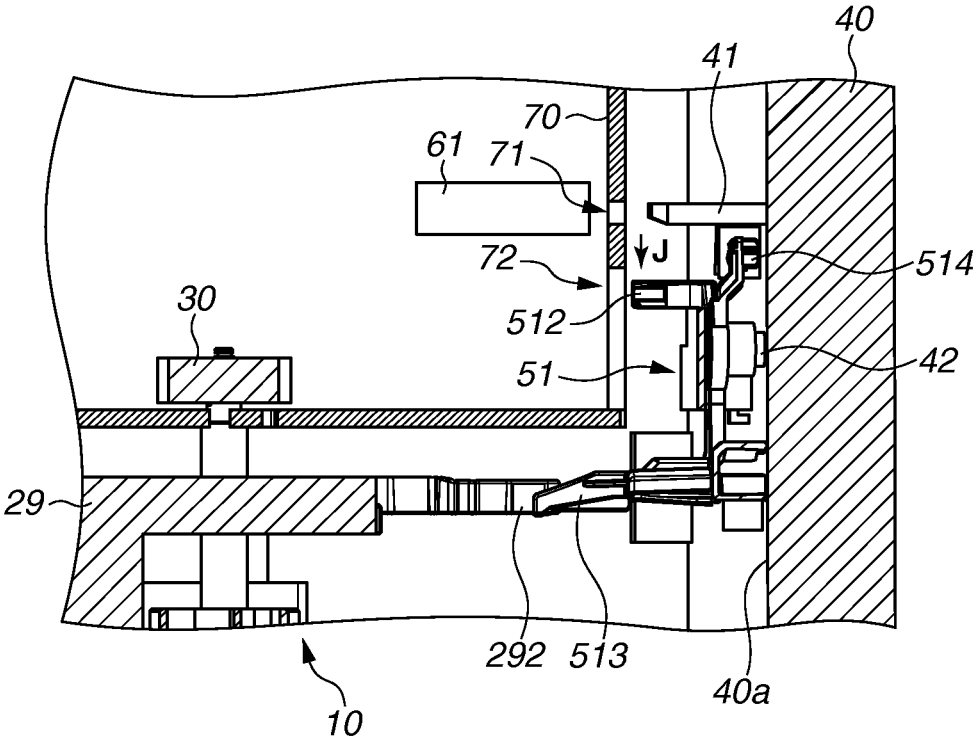
FIG. 6B illustrates the handle of the intermediate transfer unit and the moving member viewed from above the printer.
Figure 7A:
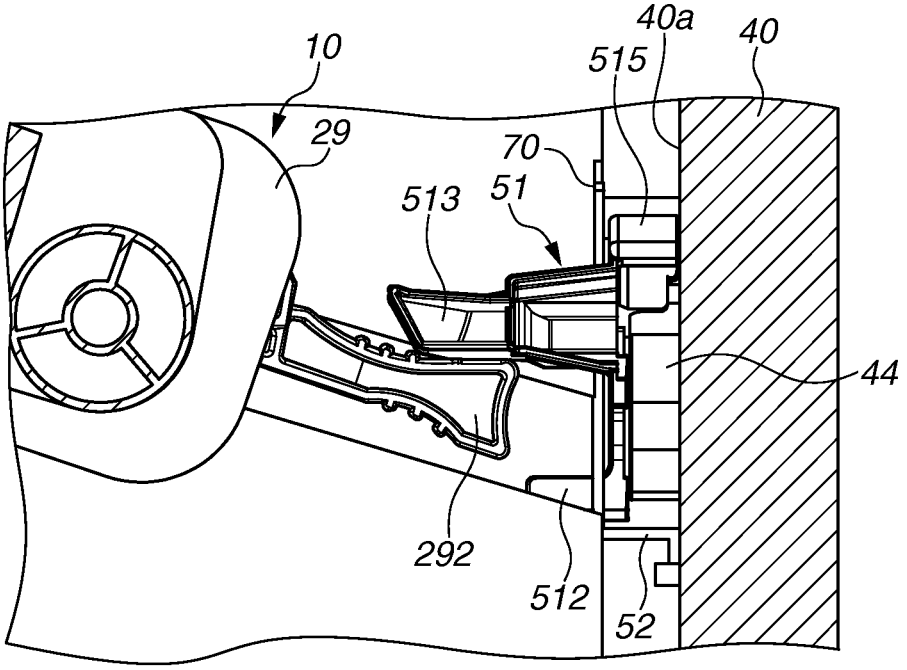
FIG. 7A illustrates the handle of the intermediate transfer unit and the moving member viewed from the front side of the printer.
Figure 7B:
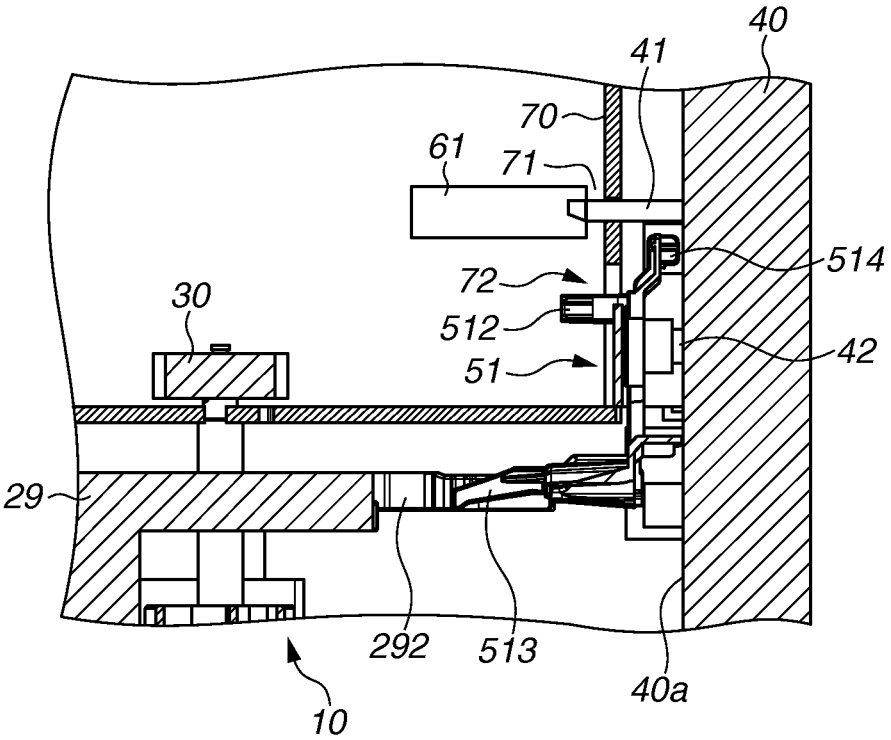
FIG. 7B illustrates the handle of the intermediate transfer unit and the moving member viewed from above the printer.

With reference to FIGS. 5A to 7B, the operation of the interference mechanism 50 in a state where the intermediate transfer unit 10 is attached in the body 1*a* is described. FIGS. 5A to 7B illustrate the operation of the interference mechanism 50 performed step by step in closing the right door 40 in a state where the intermediate transfer unit 10 is attached in the body 1*a*. FIGS. 5A, 6A, and 7A illustrate the handle 292 of the intermediate transfer unit 10 and the moving member 51 viewed from the front side of the printer 1. FIGS. 5B, 6B, and 7B illustrate the handle 292 of the intermediate transfer unit 10 and the moving member 51 viewed from above the printer 1.

As illustrated in FIGS. 5A and 5B, in the process of closing the right door 40 in the arrow G direction in the state where the intermediate transfer unit 10 is attached in the body 1*a*, the handle 292 of the intermediate transfer unit 10 comes in contact with the intermediate transfer unit contact portion 513 of the moving member 51 on an inclined plane 513*a*. As will be seen from FIG. 5B, in this processing, the switching member 41 and the tip of the contact portion 512 of the right door 40 are at positions(a second position) at which they do not contact the inner cover member 70.

As illustrated in FIGS. 6A and 6B, in further closing the right door 40, the right door 40 receives a force in the H direction (vertically upward direction) from the handle 292 on the inclined plane 513*a* of the intermediate transfer unit contact portion 513. The force becomes a moment for turning the moving member 51 in the counterclockwise direction (r1 direction (see FIG. 1)) viewed from the inner side of the body 1*a*. The moment compresses the compression spring 53 against the moment in the clockwise direction (r2direction (see FIG. 1)) by the compression spring 53, and thereby the moving member 51 turns in the r1 direction. A constant of spring of the compression spring 53 is set to a level at which the load in compressing the compression spring 53 does not substantially affect the normal opening/closing operation of the right door 40. At the time of operation, as illustrated in FIG. 6B, the tip of the switching member 41 of the right door 40 has not reached the first opening 71 of the inner cover member 70. Further, the tip of the contact portion 512 of the moving member 51 has not also reached the inner cover member 70, and by the above-described rotation of the moving member 51 in the counterclockwise direction, the moving member 51 moves in the direction of the front side (J direction in FIG. 6B) of the body 1*a*. As described above, the moving member 51 rotates in the direction of the second opening before the tip of the contact portion 512 reaches the inner cover member 70, and thereby the interference between the moving member 51 and the inner cover member 70 can be prevented.

Figure 8:
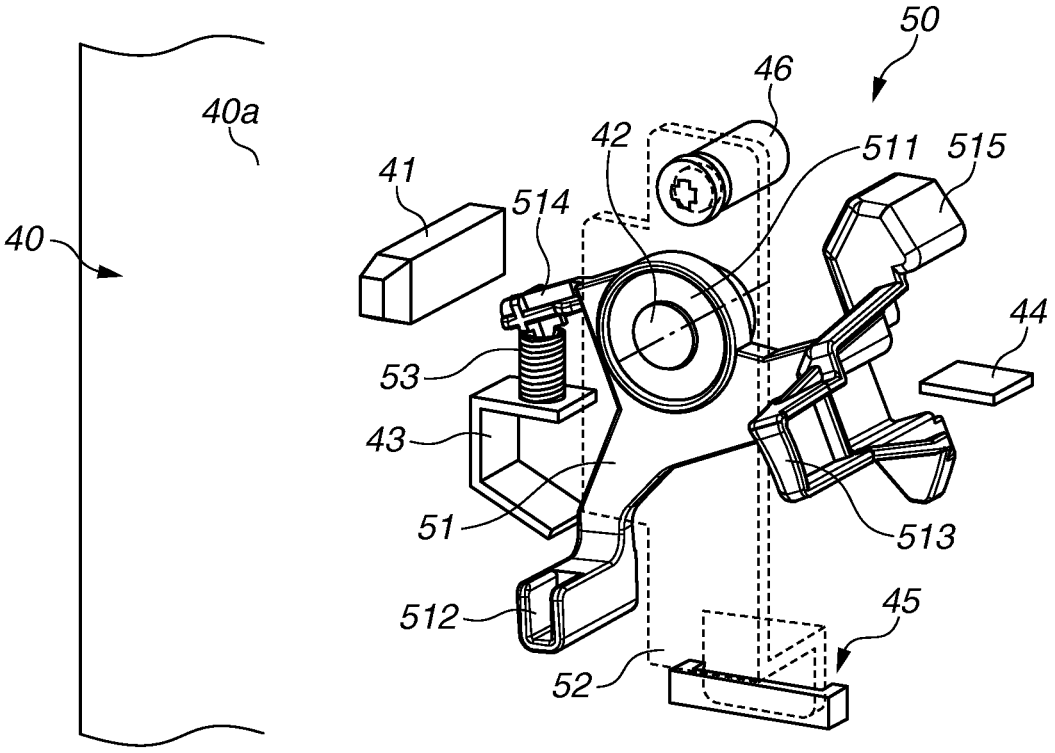
FIG. 8 is a perspective view illustrating the interference mechanism in a state where the right door is completely closed.

FIGS. 7A and 7B illustrate a state (completely door-closed state) where the right door 40 is completely closed. FIG. 8 is a perspective view illustrating the interference mechanism 50 in a state where the right door 40 is in the completely door-closed state. As illustrated in FIG. 7A, the intermediate transfer unit contact portion 513 of the moving member 51 keeps contacting the handle 292, and as compared to the state where the intermediate transfer unit contact portion 513 does not contact the handle 292, the intermediate transfer unit contact portion 513 keeps the state rotating in the counterclockwise direction when viewed from the inside of the body 1*a*. Consequently, as illustrated in FIG. 7B, the contact portion 512 of the moving member 51 is inserted into the second opening 72 without contacting the inner cover member 70, and the switching member 41 is also inserted into the first opening 71 of the inner cover member 70. Consequently, when the right door 40 is in the completely door-closed state, the switching member 41 presses the switch 61, and the prohibition of the image formation operation is released.

As described above, in the state where the intermediate transfer unit 10 is attached to the inside of the body 1*a*, if the right door 40 is closed, in the closing operation, the intermediate transfer unit contact portion 513 of the moving member 51 comes in contact with the handle 292 of the intermediate transfer unit 10, and thereby the moving member 51 rotates. By this rotation, before the tip of the contact portion 512 reaches the inner cover member 70, the contact portion 512 moves to the direction of the second opening 72 of the inner cover member 70, and thereby the intermediate transfer unit contact portion 513 does not interfere with the inner cover member 70. This allows the right door 40 to be in the completely door-closed state.

(2) A Case where the Intermediate Transfer Unit 10 is not Attached to the Body 1*a*

With reference FIG. 9, the operation of the interference mechanism 50 in a state (detached state) where the intermediate transfer unit 10 is not attached in the body 1*a* is described. FIG. 9 illustrates a positional relationship of the interference mechanism in a state where the moving member 51 is preventing the right door 40 from becoming the completely door-closed state viewed from directly above. Nothing contacts the intermediate transfer unit contact portion 513. Thus, the moving member 51 is urged in the clockwise direction viewed from the inside of the body 1*a*, by the compression spring 53, and is maintained at the position where the rotation stopping portion 515 comes in contact with the rib 44 of the right door 40(a first position). If the right door 40 is closed while this state is maintained, the contact portion 512 of the moving member 51 comes in contact with the inner cover member 70, and the contact portion 512 is held between the inner cover member 70 and the rib 43 of the right door 40, and thereby the right door 40 interferes with the inner cover member 70. This interference prevents the right door 40 from becoming the completely door-closed state, and consequently, the switch 61 is not turned on by the switching member 41, and it is not possible to release the prohibition of the image formation operation.

The position of the portion (tip portion) that presses the switch 61 of the switching member 41 of the right door 40 is located at a position closer to the inner surface 40*a* of the right door 40 than the portion (tip portion) of the contact portion 512 of the moving member 51 contacting the inner cover member 70. This prevents the switching member 41 from reaching the first opening 71 of the inner cover member 70 in a state where the contact portion 512 contacts the inner cover member 70 to prevent the switching member 41 from pressing the switch 61.

As described above, when the right door 40 is closed in the state where the intermediate transfer unit 10 is not attached in the body 1*a*, the position of the moving member 51 relative to the right door 40 is not changed, and the contact portion 512 interferes with the inner cover member 70 to prevent the completely door-closed state. This prevents releasing the prohibition of the image formation operation.

As described above, according to the exemplary embodiment, when the intermediate transfer unit 10 is attached to the inside of the body 1*a*, the right door 40 is completely closed to turn on the switch 61, and thereby the prohibition of the image formation operation can be released. On the other hand, when the intermediate transfer unit 10 is not attached to the inside of the body 1*a*, in closing the right door 40, the moving member 51 interferes with the inner cover member 70 and the right door 40 is not completely closed, and consequently, the switch 61 is not turned on, and it is impossible to release the prohibition of the image formation operation. This prevents, with this simple structure, the switch 61 from being turned on when the intermediate transfer unit 10 is not attached to the body, and the image formation operation can be prohibited.

When the intermediate transfer unit 10 is not attached to the inside of the body 1*a*, by preventing the right door 40 from being completely closed, a user can be notified that the intermediate transfer unit 10 is not attached to the inside the body 1 when the user closes the right door 40. Consequently, as compared to the structure in which the apparatus is operated after the right door 40 is closed to detect whether the intermediate transfer unit 10 is attached, and a notification that the intermediate transfer unit 10 is not attached to the body 1*a* is issued, the user can be notified at an early stage that the intermediate transfer unit 10 is not attached. Consequently, the usability in the attachment of the intermediate transfer unit can be increased. Further, in the state where the completely door-closed state of the right door 40 is prevented, the switching member 41 of the right door 40 is prevented from reaching the first opening 71 of the inner cover member 70 for turning on the switch 61, and thereby the print operation can be surely stopped and the safety can be ensured. Further, the interference mechanism 50 is provided on the right door 40, and consequently, in attaching or detaching the intermediate transfer unit 10, the intermediate transfer unit 10 and the moving member 51 do not contact with each other, and do not interrupt the attachment and detachment operation. Especially, for a unit sensitive to damage and a bump such as an intermediate transfer unit 10, the structure is effective to prevent the risk.

Further, by providing the rotation shaft of the moving member 51 to be perpendicular to the open-close directions of the right door 40, the increase in the space to be provided to ensure the movable area for the moving member 51, in the body 1*a* can be prevented. By this structure, even if the right door 40 is closed sharply in the state where the intermediate transfer unit 10 is not attached to the body 1*a*, the inertial force by the closing operation of the right door 40 has little effect on the rotation of the moving member 51 to the right door 40. Further, when the moving member 51 contacts the inner cover member 70, the reaction force from the inner cover member 70 to the moving member 51 is substantially in parallel with the rotational axis direction of the moving member 51, and consequently, this structure has little effect on the rotation of the moving member 51 relative to the right door 40. By the above-described features, the moving member 51 can surely prevent the right door 40 from becoming the completely door-closed state. Further, since the moving member 51 interferes with the inner cover member 70 in the same direction as the open-close directions of the door, only the force in the compression direction acts, and it is not necessary to consider the moment. Consequently, with this simple structure, the right door 40 can be prevented from becoming the completely door-closed state.

Further, the moving member 51 is urged toward the position interfering with the inner cover member 70 (the first position) by the compression spring 53, and only when the intermediate transfer unit 10 is attached to the inside of the body 1*a*, the moving member 51 rotates relative to the right door 40, and moves to the position not interfering with the inner cover member 70 (the second position). Consequently, only when the intermediate transfer unit 10 is not attached to the body 1*a*, the right door 40 can be prevented from becoming the completely door-closed state. The moving member 51 may be urged toward the position not interfering with the inner cover member 70 (the second position), by the compression spring 53. In this case, when the intermediate transfer unit 10 is not attached to the inside of the body 1*a*, the right door 40 is closed, and then, in the closing process, a predetermined portion of the moving member 51 contacts a predetermined portion of the apparatus body 1*a*. Thereby, the moving member 51 may move to the position interfering with the inner cover member 70 (the first position). Further, when the right door 40 is located at a position further opened than the position where the contact portion 512 of the moving member 51 contacts the inner cover member 70, the space between the right door 40 and the inner cover member 70 is regulated to be a space preventing the user's hand from putting in the space. This prevents the switch 61 from being turned on even if the user forcibly rotates the moving member 51 relative to the right door 40 and the moving member 51 moves to the position at which the contact portion 512 does not contact the inner cover member 70 regardless of the state where the intermediate transfer unit 10 is not attached. That is, before the contact portion 512 reaches the position at which the contact portion 512 contacts the inner cover member 70, the space between the right door 40 and the inner cover member 70 becomes a space narrow enough to prevent the user's hand from putting in the space, and thus, the forcible movement of the moving member 51 by the user can be released. Consequently, by the compression spring 53, the moving member 51 is returned to the position surely interfering with the inner cover member 70, and the switch 61 can be prevented from being turned on.

Further, the moving member 51 contacts the handle 292 of the intermediate transfer unit 10, and thereby it is unnecessary to add an unnecessary shape to the intermediate transfer unit 10. Thus, The size of the apparatus can be reduced, and the space can be saved.

In the structure of always urging the moving member 51 to the position at which the contact portion 512 contacts the inner cover member 70, in place of the compression spring 53, a torsion coil spring, or a extension spring can be used for urging, or the weight of the moving member 51 itself can be used for urging.

Figure 12A:
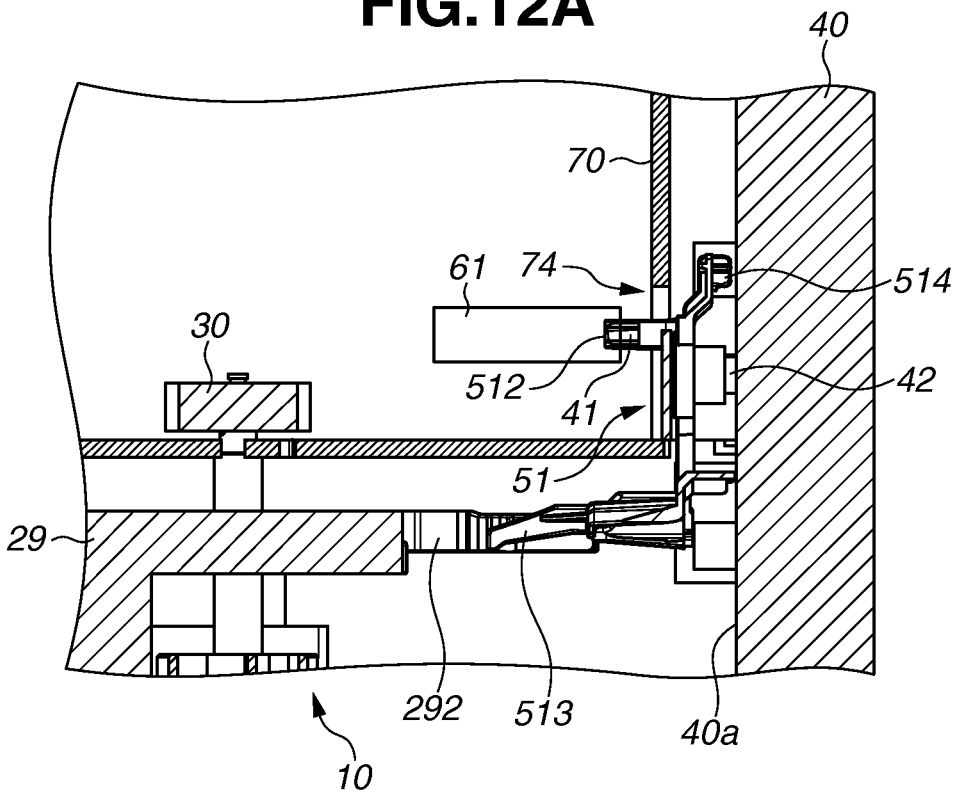
FIG. 12A illustrates the moving member viewed from above the printer in a state where the intermediate transfer unit is attached to the body.
Figure 12B:
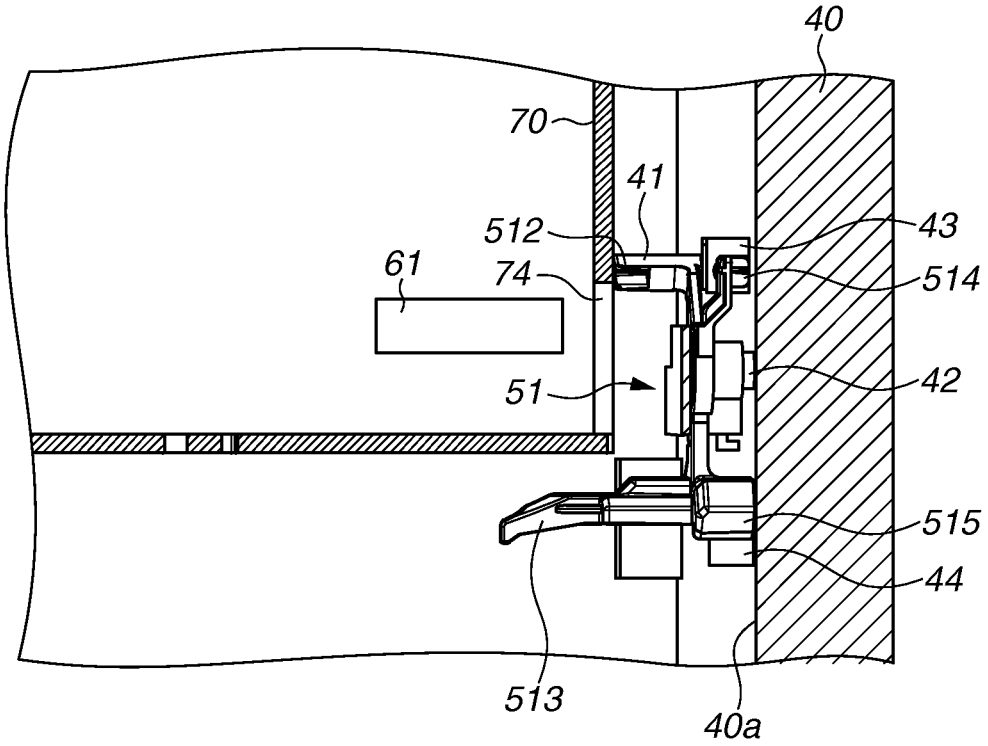
FIG. 12B illustrates the moving member viewed from above the printer in a state where the intermediate transfer unit is not attached to the body.

The second exemplary embodiment is described. In the description of the second exemplary embodiment, only components different from those in the first exemplary embodiment will be described, and descriptions of components similar to those in the first exemplary embodiment are omitted. To the components similar to those in the first exemplary embodiment, the same reference numerals are applied. FIG. 12A and FIG. 12B illustrate the moving member 51 viewed from above the printer 1. FIG. 12A illustrates a state where the intermediate transfer unit 10 is attached to the body 1*a*. FIG. 12B illustrates a state where the intermediate transfer unit 10 is not attached to the body 1*a*.

In the first exemplary embodiment, the switching member 41 for pressing the switch 61 is provided at the position different from the moving member 51, of the right door 40. In the second exemplary embodiment, the switching member 41 is provided on the moving member 51. As illustrated in FIG. 12A, on the moving member 51, in the direction orthogonal to the inner surface 40*a* of the right door 40, the switching member 41 protruding from the moving member 51 is provided. When the intermediate transfer unit 10 is attached to the body 1*a*, if the right door 40 is gradually closed, the intermediate transfer unit contact portion 513 comes in contact with the handle 292, and the moving member 51 rotates, in the same manner as the first exemplary embodiment. Consequently, the switching member 41 on the moving member 51 is inserted into the opening 74 provided in the inner cover member 70 to press the switch 61 without contacting the inner cover member 70, and the prohibition of the image formation operation is released.

On the other hand, when the intermediate transfer unit 10 is not attached to the body 1*a*, if the right door 40 is gradually closed as illustrated in FIG. 12B, nothing contacts the intermediate transfer unit contact portion 513, and the moving member 51 does not rotate in the same manner as the first exemplary embodiment. Consequently, the contact portion 512 formed at the tip of the switching member 41 on the moving member 51 comes in contact with the inner cover member 70, and it is impossible to close the right door 40 to the completely door-closed state, and accordingly, it is impossible to press the switch 61 with the switching member 41, and the prohibition of the image formation operation cannot be released.

As described above, according to the exemplary embodiment, the effects similar to those in the first exemplary embodiment can be obtained. That is, according to the exemplary embodiment, when the intermediate transfer unit 10 is attached to the inside of the body 1*a*, the right door 40 is completely closed to turn on the switch 61, and thereby the prohibition of the image formation operation can be released. On the other hand, when the intermediate transfer unit 10 is not attached to the inside of the body 1*a*, in closing the right door 40, the moving member 51 interferes with the inner cover member 70 and the right door 40 is not completely closed, and consequently, the switch 61 is not turned on, and it is impossible to release the prohibition of the image formation operation. This prevents, with this simple structure, the switch 61 from being turned on when the intermediate transfer unit 10 is not attached to the body, and the image formation operation can be prohibited.

Further, in this exemplary embodiment, the switching member 41 is provided on the moving member 51 that is a different member from the right door 40. Consequently, the structure of the right door 40 can be simplified.

In this exemplary embodiment, at the tip of the switching member 41, the contact portion 512 is formed, however, the switching member 41 and the contact portion 512 can separately protrude from the moving member 51. However, the contact portion 512 formed at the tip of the switching member 41 can further reduce the size of the moving member 51, and the size of the whole image forming apparatus 1 can be reduced.

Figure 13A:
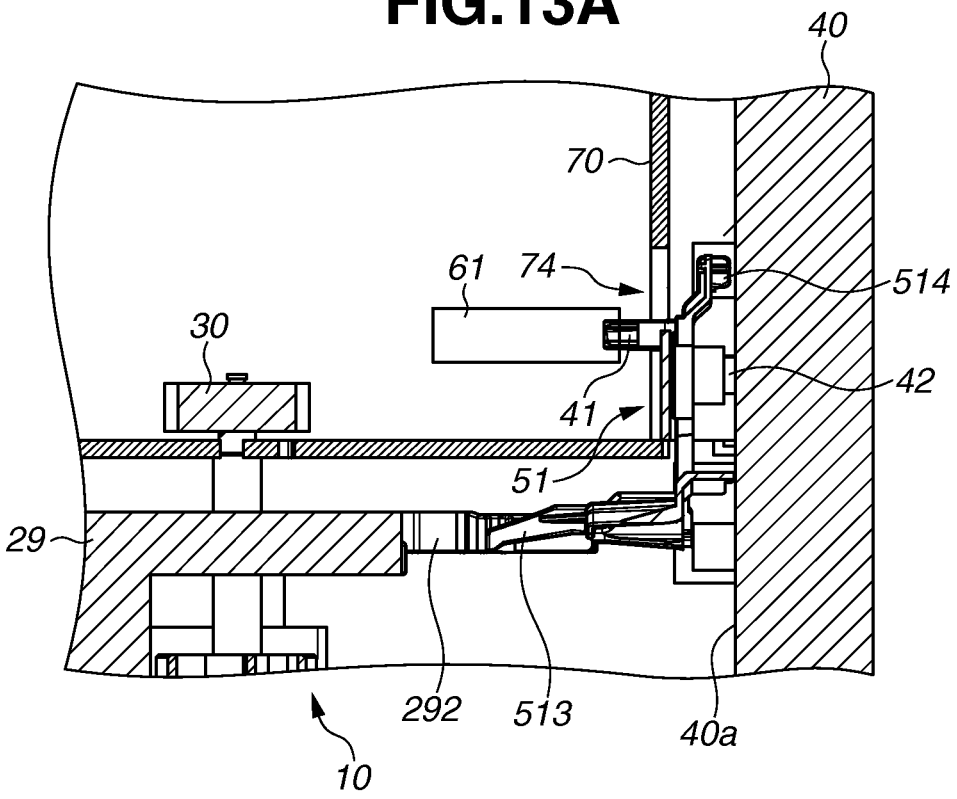
FIG. 13A illustrates the moving member viewed from above the printer in a state where the intermediate transfer unit is attached to the body.
Figure 13B:
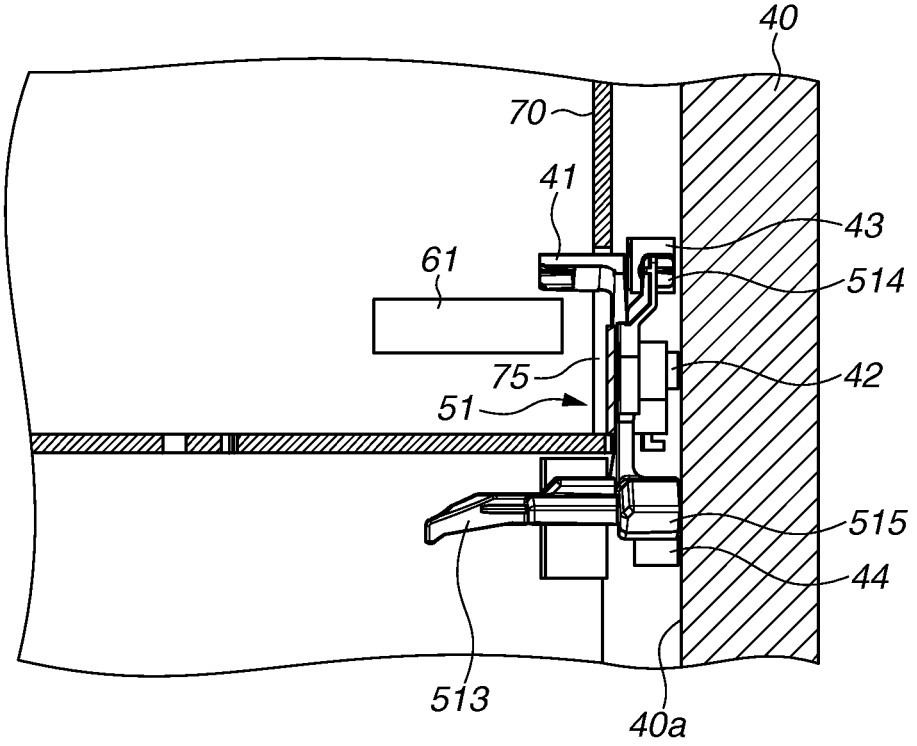
FIG. 13B illustrates the moving member viewed from above the printer in a state where the intermediate transfer unit is not attached to the body.

The third exemplary embodiment is described. In the description of the third exemplary embodiment, only components different from those in the second exemplary embodiment will be described, and descriptions of components similar to those in the second exemplary embodiment are omitted. To the components similar to those in the second exemplary embodiment, the same reference numerals are applied. FIG. 13A and FIG. 13B illustrate the moving member 51 viewed from above the printer 1. FIG. 13A illustrates a state where the intermediate transfer unit 10 is attached to the body 1*a*. FIG. 13B illustrates a state where the intermediate transfer unit 10 is not attached to the body 1*a*.

In the first exemplary embodiment and the second exemplary embodiment, when the intermediate transfer unit 10 is not attached to the body 1*a*, it is impossible to completely close (become the completely door-closed state) the right door 40 against the body 1*a*. In the third exemplary embodiment, a structure where the right door 40 can be completely closed against the body 1*a* but it is impossible to turn on the switch 61 is descried.

As illustrated in FIG. 13A, when the intermediate transfer unit 10 is attached to the body 1*a*, if the right door 40 is gradually closed, in the same manner as the second exemplary embodiment, the intermediate transfer unit contact portion 513 comes in contact with the handle 292, and the moving member 51 rotates. Then, the switching member 41 on the moving member 51 is inserted into the opening 75 provided on the inner cover member 70. The intermediate transfer unit contact portion 513 comes in contact with the handle 292 to turn the moving member 51, and the switching member 41 moves to a position (pressing position) at which the switching member 41 can press the switch 61. Consequently, after the switching member 41 is inserted into the opening 75, when the right door 40 is completely closed, the switch 61 is pressed and the prohibition of the image formation operation is released.

On the other hand, when the intermediate transfer unit 10 is not attached to the body 1*a*, if the right door 40 is gradually closed as illustrated in FIG. 13B, nothing contacts the intermediate transfer unit contact portion 513, and the moving member 51 does not rotate. The switching member 41 on the moving member 51 is inserted into the opening 75 provided on the inner cover member 70. Since the intermediate transfer unit 10 is not attached to the body 1*a*, at the time the switching member 41 is inserted into the opening 75, the moving member 51 is not rotating, and the switching member 41 is at a non-pressing position at which the switching member 41 cannot press the switch 61 and which is different from the pressing position. Consequently, even if the right door 40 is completely closed, the switching member 41 does not press the switch 61, and the prohibition of the image formation operation is not released.

As described above, according to the exemplary embodiment, the effects similar to those in the first and second exemplary embodiments can be obtained. That is, according to the exemplary embodiment, when the intermediate transfer unit 10 is attached to the inside of the body 1*a*, the right door 40 is completely closed to turn on the switch 61, and thereby the prohibition of the image formation operation can be released. On the other hand, when the intermediate transfer unit 10 is not attached to the inside of the body 1*a*, even if the right door 40 is closed, the switch 61 is not turned on, and the prohibition of the image formation operation cannot be released. This prevents, with this simple structure, the switch 61 from being turned on when the intermediate transfer unit 10 is not attached to the body, and the image formation operation can be prohibited.

Figure 14:
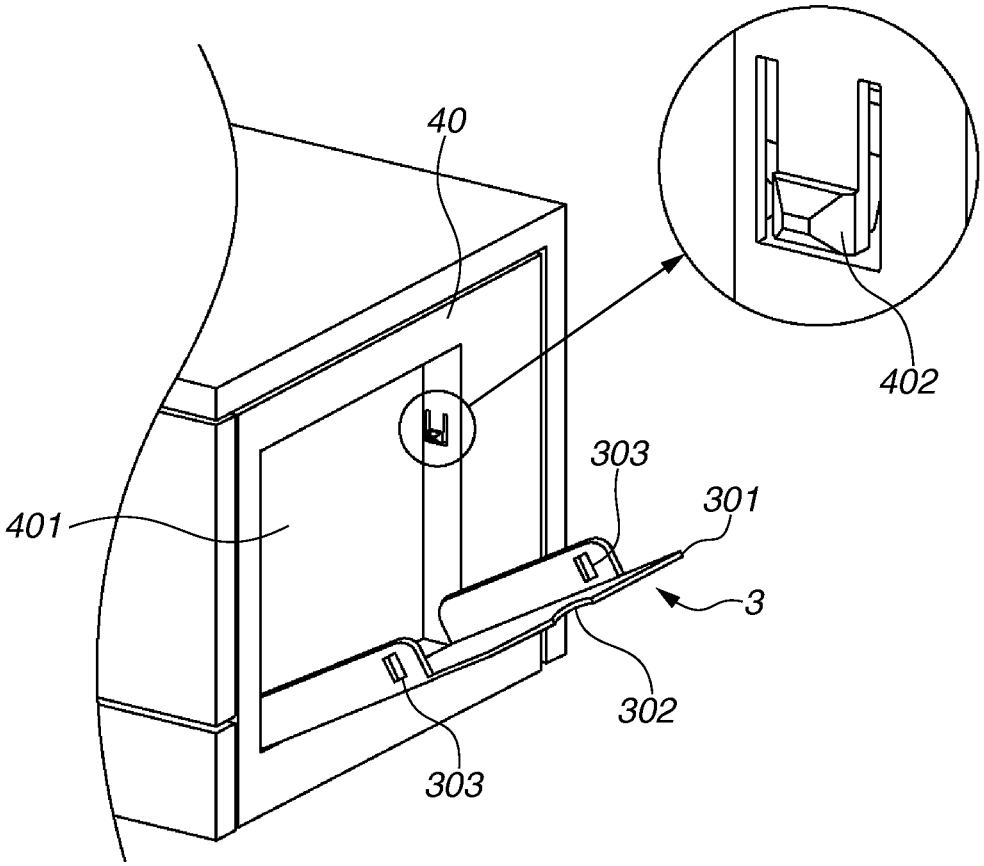
FIG. 14 is a perspective view illustrating the printer in the vicinity of a manual sheet feeding section.
Figure 15A:
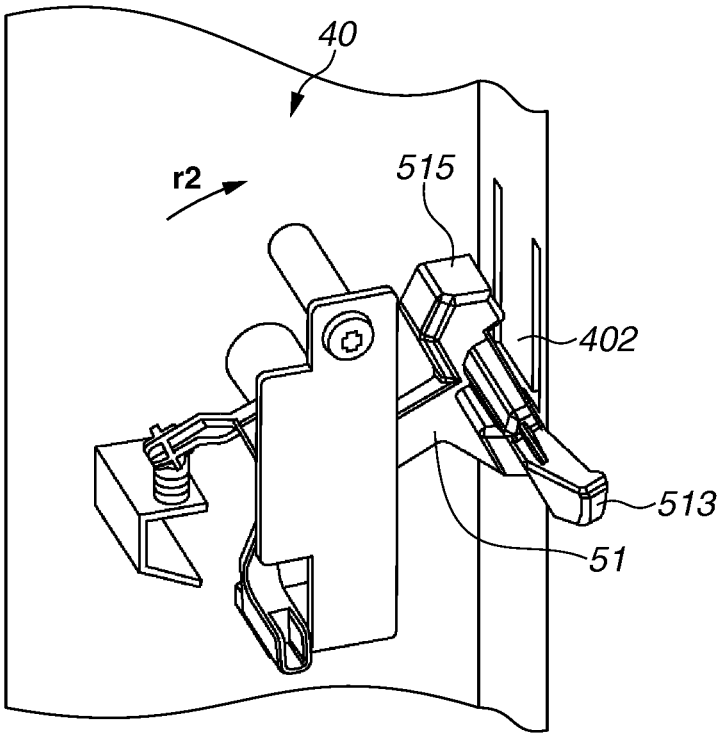
FIG. 15A is a perspective view illustrating a relationship between a rotation stopping portion and a locking claw in a state where the right door is closed.
Figure 15B:
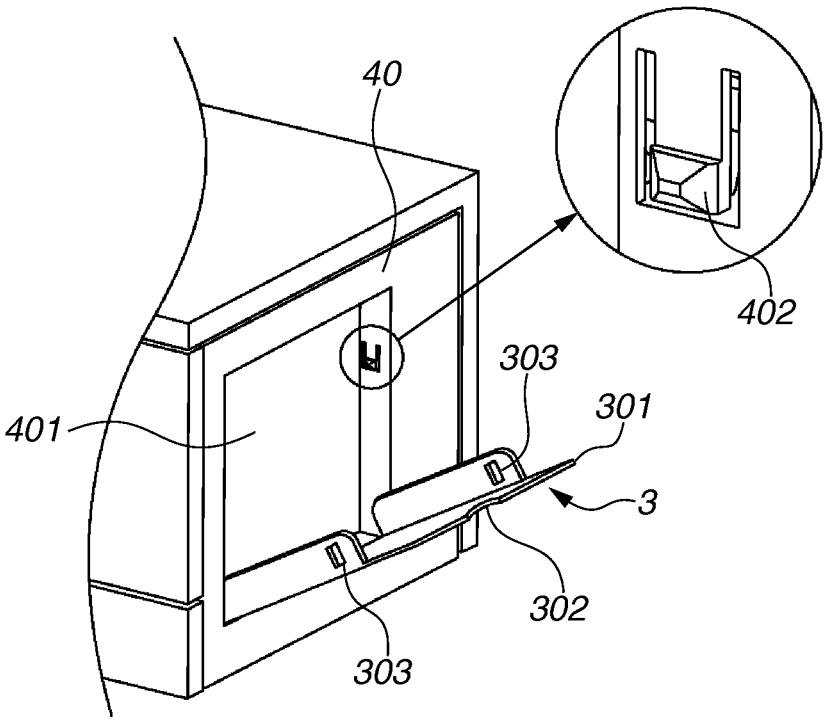
FIG. 15B is a perspective view illustrating a relationship between the rotation stopping portion and the locking claw in a state where the right door is open.

With reference to FIG. 14, FIG. 15A, and FIG. 15B, the fourth exemplary embodiment is described. In the description of the fourth exemplary embodiment, only components different from those in the first to third exemplary embodiments will be described, and descriptions of components similar to those in the first to third exemplary embodiments are omitted.

FIG. 14 is a perspective view illustrating the printer in the vicinity of the manual sheet feeding section 3. FIG. 15A is a perspective view illustrating a relationship between the rotation stopping portion 515 and a locking claw 402 in a state where the right door 40 is closed. FIG. 15B is a perspective view illustrating a relationship between the rotation stopping portion 515 and the locking claw 402 in a state where the right door is open.

As illustrated in FIG. 14, the right door 40 holds the manual sheet feeding section 3 having a manual feed tray 301 for stacking the sheet S. The manual sheet feeding section 3 is a second opening and closing member that can rotate to open and close relative to the right door 40. On the right door 40, an opening 401 for sheet feeding that faces a two-sided conveyance path, is formed. To the opening 401, the manual feed tray 301 is attached in a state where the tray can open and close in the vertical directions. When the right door 40 is open, the manual feed tray 301 rotates downward together with the right door 40 in an integrated manner. The manual feed tray 301 is supported by a rotation shaft (not illustrated) provided for the right door 40 such that the tray 301 can rotate downward against the opening 401. Further, at an upper part of the manual feed tray 301, a holding portion 302 for opening and closing is provided, and on the both sides, locking holes 303 for locking the manual feed tray 301 in the right door 40 are provided. On the side surfaces of the opening 401, the locking claws 402 that are elastic locking members are provided. The locking claws 402 is locked in the locking holes 303 to hold the manual feed tray 301 at a position closing the opening 401. The force for holding the manual feed tray 301 at the closed position is set as small as possible for users to easily open the manual feed tray 301 within a range in which the manual feed tray 301 does not easily open under normal operation of the printer body 1*a*. When a user opens the manual feed tray 301 at the position where the opening 401 is closed, the user pulls the holding portion 302 toward the user to apply a load greater than the above-described holding force. The manual feed tray 301 can be opened by deforming the locking claws 402 to release the locking relative to the locking holes 303.

In the operation of opening the right door 40, by the inertial force, a force is applied to the manual feed tray 301 in a direction for releasing the manual feed tray 301, and as a result, the manual feed tray 301 may be opened.

To solve the problem, in this exemplary embodiment, with the rotation stopping portion 515 of the moving member 51, when the right door 40 is opened, even if the force acts in the direction for releasing the manual feed tray 301, the manual feed tray 301 is prevented from being opened. Specifically, at the right back side of the locking claw 402, the rotation stopping portion 515 is disposed to prevent the locking claw 402 from being deformed. With reference to FIG. 15A and FIG. 15B, the mechanism is described in detail.

As illustrated in FIG. 15A, when the intermediate transfer unit 10 is attached to the body 1*a*, and the right door 40 is closed (completely door-closed state) against the printer body 1*a*, the rotation stopping portion 515 is retracted from the back side of the locking claw 402. In this state, the manual feed tray 301 is held to the right door 40 only by the locking claws 402. In such a state, if the user tries to open the manual feed tray 301, the locking claw 402 is released from the locking hole 303, and the locking claw 402 can be deformed as necessary, and then, the user can open the manual feed tray 301. That is, the movement of the manual feed tray 301 is not regulated by the rotation stopping portion 515, and to the manual feed tray 301, only the holding force set to allow the user to easily open the manual feed tray 301 is applied. Consequently, the manual feed tray 301 can be very easily opened. From this state, when the user starts to pull out the right door 40 from the printer body 1*a*, the intermediate transfer unit contact portion 513 starts to move away from the handle 292 of the intermediate transfer unit 10 in the same manner as the first exemplary embodiment as illustrated in FIG. 3. This allows the moving member 51 to rotate in the r2 direction indicated by the arrow in FIG. 15A, and the rotation stopping portion 515 moves to the right back side of the locking claw 402 (FIG. 15B). At the time of operation, when the locking claw 402 starts to deform, the rotation stopping portion 515 contacts at the back of the locking claw 402, and the rotation stopping portion 515 regulates the deformation of the locking claw 402. Consequently, the locking claw 402 cannot be released from the locking hole 303, and the manual feed tray 301 cannot be opened. In such a state, if the user further opens the right door 40, the rotation stopping portion 515 exists at the back of the locking claw 402 to regulate the deformation of the locking claw 402. Thus, even if the user burst open the right door 40, the manual feed tray 301 is prevented from being opened. That is, when the right door 40 is opened, the rotation stopping portion 515 regulates the movement of the manual feed tray 301, and the manual feed tray 301 is prevented from being opened.

As described above, according to the exemplary embodiment, when the right door 40 is opened, the unexpected operation of opening the manual feed tray 301 can be prevented without sacrificing operability, and the stress-free image forming apparatus can be provided for users.

With reference to FIG. 16 to FIG. 19, the fifth exemplary embodiment is described. In the description of the fifth exemplary embodiment, only components different from those in the first to fourth exemplary embodiments will be described, and descriptions of components similar to those in the first to fourth exemplary embodiments are omitted.

Figure 16:
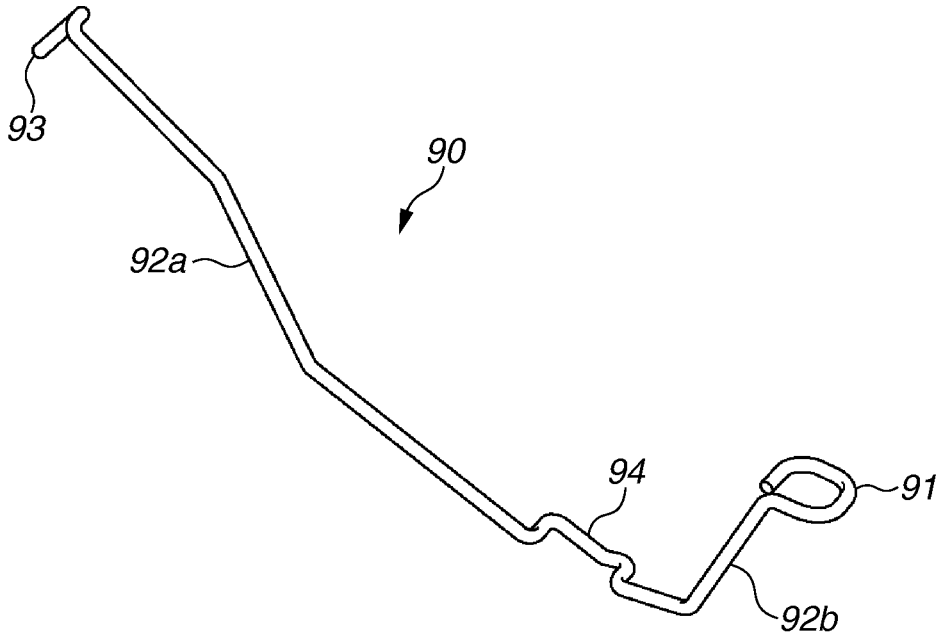
FIG. 16 is a perspective view illustrating a fixing member.
Figure 17:
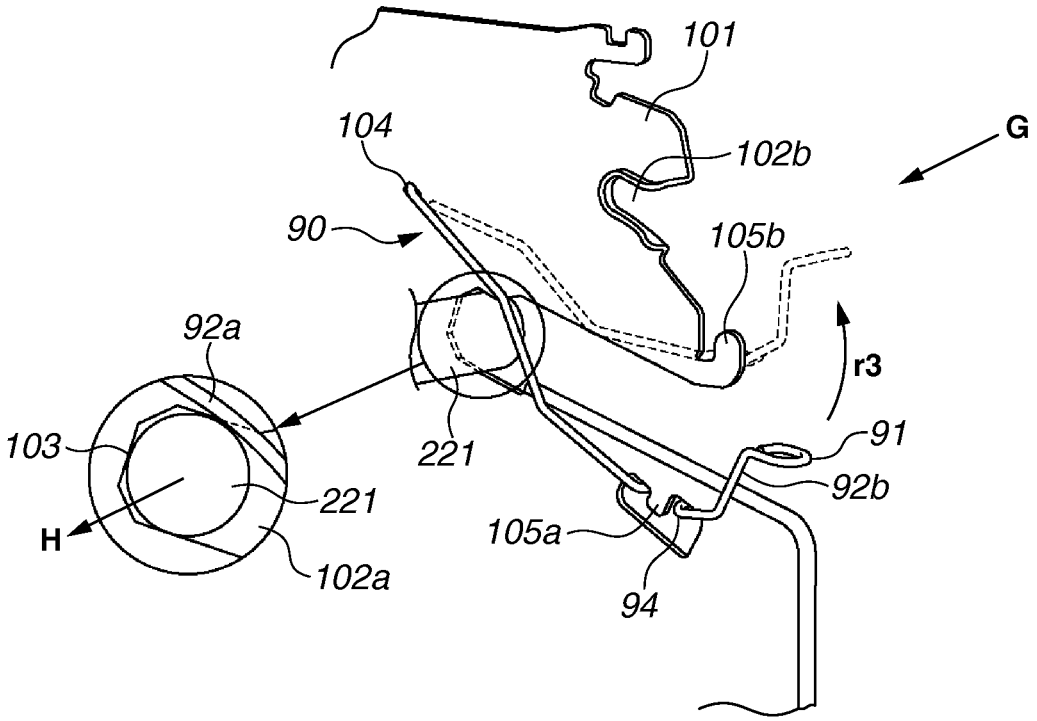
FIG. 17 is a perspective view illustrating a relationship between the fixing member and a rear side panel.
Figure 18:
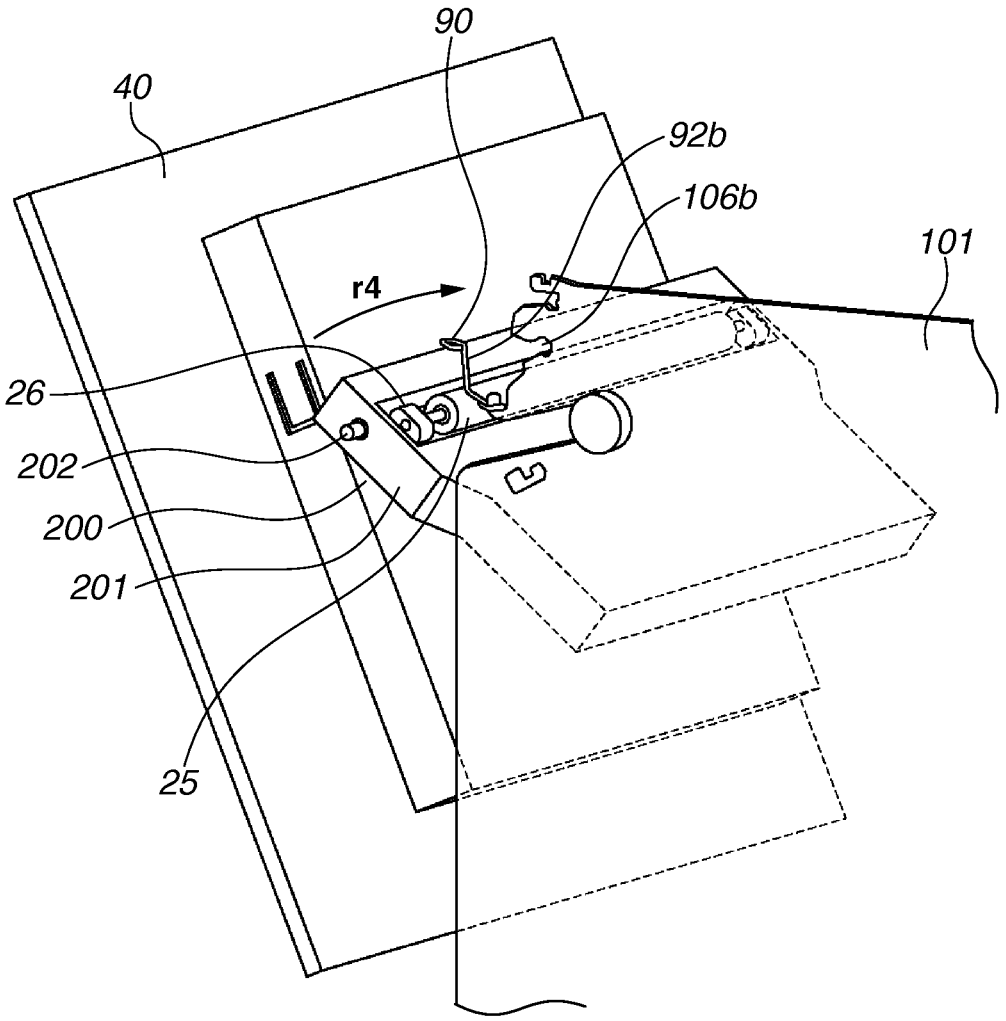
FIG. 18 is a perspective view viewed from the arrow G direction in FIG. 17 in a state where a secondary transfer unit is open.
Figure 19:
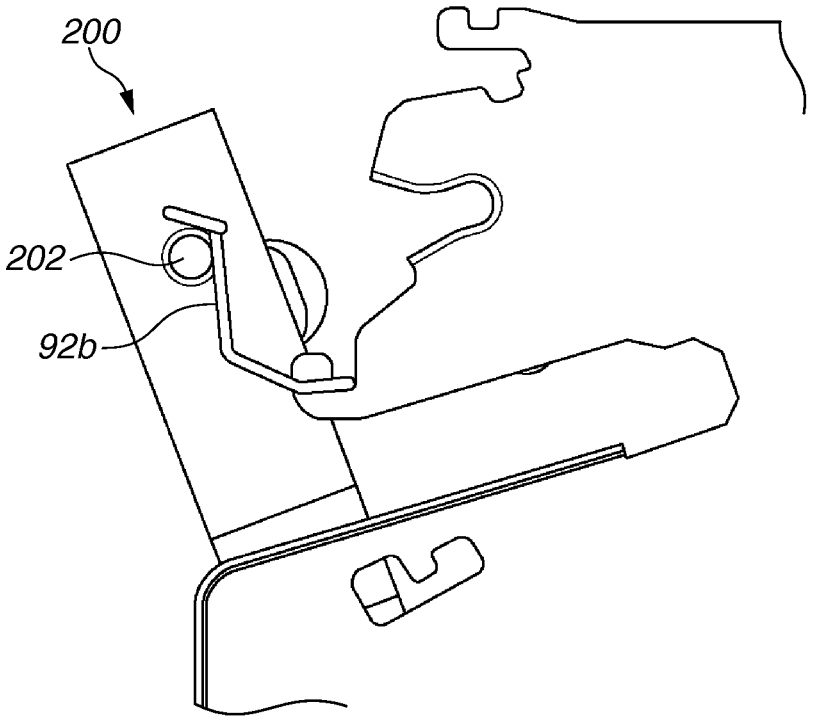
FIG. 19 illustrates interference between the secondary transfer unit and the fixing member.

FIG. 16 is a perspective view illustrating a fixing member 90. FIG. 17 is a perspective view illustrating a relationship between the fixing member 90 and a rear side panel 101. FIG. 18 is a perspective view illustrating a secondary transfer unit 200 in an opened state that is viewed from the arrow G direction in FIG. 17. FIG. 19 illustrates the interference between the secondary transfer unit 200 and the fixing member 90.

The intermediate transfer unit 10 according to the exemplary embodiment is obliquely disposed relative to the level surface in the body 1*a* (see FIG. 10). The obliquely disposed intermediate transfer unit 10 may slip down when the right door 40 is opened, and consequently, means for preventing the slip is to be provided. In this exemplary embodiment, the fixing member (regulation member) 90 is used to fix the intermediate transfer unit 10 in the body 1*a*.

As illustrated in FIG. 16, the fixing member 90 is formed by bending a metallic wire (wire rod). The fixing member 90 includes a holding portion 91, an arm 92*a*, an arm 92*b*, a hook 93, and a stepped bend 94. As illustrated in FIG. 17, the rear side panel 101 constituting the frame of the body 1*a* includes a groove 102*a*, a groove 102*b*, a contact portion 103, a hole 104, a convex portion 105*a*, and a convex portion 105*b*. Bearings 221 provided at the both ends of the drive roller 22 fit into the grooves 102*a* and contact the contact portions 103, and thereby the intermediate transfer unit 10 (not illustrated) is positioned. The hook 93 is hooked into the hole 104, and thereby the fixing member 90 is held in a state rotatable in the arrow r3 direction illustrated in FIG. 17. In the state where the intermediate transfer unit 10 is attached to the body 1*a*, the stepped bend 94 engages with the convex portion 105*a*. When the fixing member 90 is at this position (regulation position), the arm 92*a* contacts the bearing 221 in a bent state. The bending of the fixing member 90 produces an elastic force to urge the intermediate transfer unit 10 in the arrow H direction (direction in which the bearing 221 is urged against the lower end of the groove 102*a* and the contact portion 103) illustrated in FIG. 17. This urging force fixes the intermediate transfer unit 10 to the body 1*a*, and prevents the intermediate transfer unit 10 from being detached from the body 1*a*. To pull out the intermediate transfer unit 10 from the body 1*a*, the user holds the holding portion 91 to release the engagement of the convex portion 105*a* with the stepped bend 94. After releasing the engagement, the user makes the stepped bend 94 engage with the convex portion 105*b* to hold the fixing member 90. When the fixing member 90 is engaged with the convex portion 105*b* and held at the regulated position, the fixing member 90 does not regulate the attachment and detachment of the intermediate transfer unit 10 to and from the body 1*a*. Thereby, the intermediate transfer unit 10 can be inserted and removed into and from the body 1*a*.

As illustrated in FIG. 18, the bearings 26 holding the secondary transfer roller 25 in a rotatable state are provided in the secondary transfer frame 201, and integrally provided as the secondary transfer unit 200. The secondary transfer frame 201 includes a boss 202. The secondary transfer frame 201 fits into a groove 106*b* provided in the rear side panel 101 to position the secondary transfer unit 200 relative to the body 1*a*. The secondary transfer unit 200 is held at a lower part of the body 1*a* with a rotation shaft (not illustrated) in a rotatable state. To enable the intermediate transfer unit 10 to be inserted and removed into and from the body 1*a*, the secondary transfer unit 200 can be opened or closed against the body 1*a*. When the right door 40 is closed, the inner surface of the right door 40 pushes the secondary transfer unit 200 from the back and thereby the secondary transfer unit 200 moves to close in conjunction with the right door 40 in the arrow r4 direction illustrated in FIG. 18.

As illustrated in FIG. 19, when the intermediate transfer unit 10 is removed from the inside of the body 1*a*, and the fixing member 90 is at the regulated position, if the user tries to close the secondary transfer unit 200, the boss 202 interferes with the arm 92*b* of the fixing member 90. This regulates the closing of the secondary transfer unit 200 (the unit 200 cannot be closed). Consequently, the right door 40 cannot be closed.

As described above, according to the exemplary embodiment, when the intermediate transfer unit 10 is not attached to the inside of the body 1*a*, the secondary transfer unit 200 and the right door 40 cannot be closed, and consequently, the effects similar to those in the first exemplary embodiment can be obtained.

In the first to fifth exemplary embodiments, the intermediate transfer unit 10 having the intermediate transfer belt 21 is the belt unit that can be attached and detached to and from the body 1*a*. The belt unit is, however, not limited to the above-described one. That is, in place of the intermediate transfer belt 21, a unit having a conveyance belt for conveying the sheet S can be used as the belt unit.

In the first to fifth exemplary embodiments, the directions for attaching and detaching the intermediate transfer unit 10 to and from the body 1*a* are directions orthogonal to or substantially orthogonal to the rotational axis direction of the rollers (the drive roller 22, the secondary transfer counter roller 24, and the like) for stretching the intermediate transfer belt 21 or the photosensitive member 5. However, the directions for attaching and detaching the intermediate transfer unit 10 to and from the body 1*a* are not limited to the directions. That is, the directions for attaching and detaching the intermediate transfer unit 10 to and from the body 1*a* can be directions parallel to or substantially parallel to the rotational axis direction of the rollers (the drive roller 22, the secondary transfer counter roller 24, and the like) for stretching the intermediate transfer belt 21 or the photosensitive member 5.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-091957 filed Apr. 25, 2014, and Japanese Patent Application No. 2014-262503, filed Dec. 25, 2014, which are hereby incorporated by reference herein in their entirety.

What is claimed is:

1. An image forming apparatus configured to form an image onto a recording material, the image forming apparatus comprising:

a belt unit having a belt contacting the recording material;

an opening and closing member openable and closable against an apparatus body;

a switch configured to switch a state where image formation operation is prohibited and a state where the prohibition is released;

a switching member capable of pressing the switch, the switching member being provided on the opening and closing member; and a moving member movably held on the opening and closing member, wherein the image formation operation prohibited state is switched by pressing the switch and releasing the pressing by the switching member, wherein the pressing of the switch by the switching member is released and the image formation operation is prohibited when the opening and closing member is opened against the apparatus body, wherein the belt unit can be detached and attached to the apparatus body when the opening and closing member is opened against the apparatus body, wherein the moving member is positioned at a first position or a second position different from the first position relative to the opening and closing member when the opening and closing member is closed, depending on whether the belt unit is attached or not attached to the apparatus body, wherein when the opening and closing member is closed against the apparatus body in a case where the belt unit is not attached to the apparatus body, the moving member is positioned at the first position, the switching member cannot press the switch by causing the moving member to contact the apparatus body, and the image formation operation is prohibited, and wherein when the opening and closing member is closed against the apparatus body in a case where the belt unit is attached to the apparatus body, the moving member is positioned at the second position, the switching member presses the switch and the prohibition of the image formation operation is released.

2. The image forming apparatus according to claim 1, wherein in the case where the belt unit is not attached to the apparatus body, the opening and closing member is prevented from being completely closed against the apparatus body by causing the moving member to contact the apparatus body.

3. The image forming apparatus according to claim 2, wherein the moving member includes a contact portion configured to contact the apparatus body to prevent the opening and closing member from being completely closed against the apparatus body in the case where the belt unit is not attached to the apparatus body and when the opening and closing member is closed against the apparatus body.

4. The image forming apparatus according to claim 3, wherein the switching member is held in the moving member.

5. The image forming apparatus according to claim 4, wherein the switching member includes the contact member.

6. The image forming apparatus according to claim 1, wherein the moving member rotates relative to the opening and closing member to move relative to the opening and closing member.

7. The image forming apparatus according to claim 1, wherein when the opening and closing member is closed, the moving member contacts the belt unit attached to the apparatus body to move relative to the opening and closing member.

8. The image forming apparatus according to claim 1, wherein the state where the image formation operation is prohibited is a state where a drive of the endless belt is stopped.

9. The image forming apparatus according to claim 1, further comprising a fixing device configured to heat the recording material, wherein the state where the image formation operation is prohibited is a state where a drive of the fixing device and/or power supply to the fixing device is stopped.

10. The image forming apparatus according to claim 1, further comprising a photosensitive member on which a toner image is formed, wherein the endless belt transfers the toner image transferred from the photosensitive member, onto the recording material.

11. An image forming apparatus configured to form an image onto a recording material, the image forming apparatus comprising:

a belt unit having a belt contacting the recording material;

an opening and closing member openable and closable against an apparatus body;

a switch configured to switch a state where image formation operation is prohibited and a state where the prohibition is released;

a switching member capable of pressing the switch; and a moving member movably held on the opening and closing member, the moving member being positioned at different positions relative to the opening and closing member when the opening and closing member is closed, depending on whether the belt unit is attached or not attached to the apparatus body, wherein the image formation operation prohibited state is switched by pressing the switch and releasing the pressing by the switching member, wherein the pressing of the switch by the switching member is released and the image formation operation is prohibited when the opening and closing member is opened against the apparatus body, wherein the belt unit can be detached and attached to the apparatus body when the opening and closing member is opened against the apparatus body, wherein the switching member is held in the moving member, and when the opening and closing member is closed against the apparatus body in the case where the belt unit is not attached to the apparatus body, the switching member does not press the switch and the image formation operation is prohibited, and wherein when the opening and closing member is closed against the apparatus body in a case where the belt unit is attached to the apparatus body, the switching member presses the switch and the prohibition of the image formation operation is released.

12. The image forming apparatus according to claim 11, wherein the moving member rotates relative to the opening and closing member to move relative to the opening and closing member.

13. The image forming apparatus according to claim 11, wherein when the opening and closing member is closed, the moving member contacts the belt unit attached to the apparatus body to move relative to the opening and closing member.

14. The image forming apparatus according to claim 13, further comprising a second opening and closing member openable and closable relative to the opening and closing member, wherein, in a state where the belt unit is attached to the apparatus body and the opening and closing member is closed, the moving member does not regulate the movement of the second opening and closing member relative to the opening and closing member, and in a state where the opening and closing member is open, regulates the movement of the second opening and closing member relative to the opening and closing member.

15. An image forming apparatus configured to form an image onto a recording material, the image forming apparatus comprising:

a belt unit having a belt contacting the recording material;

an opening and closing member openable and closable against an apparatus body; and a moving member movably held on the opening and closing member, wherein when the opening and closing member is opened against the apparatus body, the belt unit can be detached and attached to the apparatus body wherein the moving member includes a contact portion configured to contact the apparatus body to prevent the opening and closing member from being completely closed against the apparatus body in the case where the belt unit is not attached to the apparatus body and when the opening and closing member is closed against the apparatus body, wherein when the belt unit is not attached to the apparatus body, the opening and closing member is prevented from being completely closed against the apparatus body, and when the belt unit is attached to the apparatus body, the opening and closing member can be completely closed against the apparatus body, wherein the contact portion is positioned at different positions relative to the opening and closing member when the opening and closing member is closed, depending on whether the belt unit is attached or not attached to the apparatus body.

16. The image forming apparatus according to claim 15, wherein the moving member rotates relative to the opening and closing member to move relative to the opening and closing member.

17. The image forming apparatus according to claim 15, wherein when the opening and closing member is closed, the moving member contacts the belt unit attached to the apparatus body to move relative to the opening and closing member.

18. The image forming apparatus according to claim 17, further comprising a second opening and closing member openable and closable against the opening and closing member, wherein, in a state where the belt unit is attached to the apparatus body and the opening and closing member is closed, the moving member does not regulate the movement of the second opening and closing member against the opening and closing member, and in a state where the opening and closing member is open, regulates the movement of the second opening and closing member against the opening and closing member.

19. The image forming apparatus according to claim 15, further comprising a photosensitive member on which a toner image is formed, wherein the belt transfers the toner image transferred from the photosensitive member, onto the recording material.

20. An image forming apparatus configured to form an image onto a recording material, the image forming apparatus comprising:

a belt unit having a belt contacting the recording material;

an opening and closing member openable and closable against an apparatus body, wherein when the opening and closing member is opened against the apparatus body, the belt unit can be detached and attached to the apparatus body; and a regulation member configured to prevent from being detached the belt unit attached to the apparatus body, the regulation member being able to move to a first position for preventing the belt unit from being detached from the apparatus body, and to a second position where the belt unit can be detached from the apparatus body, wherein the regulation member positioned at the second position prevents the opening and closing member from being closed against the apparatus body.

21. The image forming apparatus according to claim 20, further comprising a photosensitive member on which a toner image is formed, wherein the belt transfers the toner image transferred from the photosensitive member, onto the recording material.

22. An image forming apparatus configured to form an image onto a recording material, the image forming apparatus comprising:

an opening and closing member openable and closable against an apparatus body; and a moving member movably held on the opening and closing member, wherein the moving member includes a contact portion that can contact the apparatus body, wherein when the opening and closing member is opened against the apparatus body, a belt unit having a belt contacting the recording material can be detached and attached to the apparatus body, wherein the moving member moves relative to the opening and closing member to be able to move to a first position or a second position, and wherein: when the belt unit is not attached to the apparatus body, the moving member is positioned at the first position, and by causing the contact portion to contact the apparatus body the opening and closing member is prevented from being completely closed against the apparatus body; and when the belt unit is attached to the apparatus body, the moving member is positioned at the second position and the opening and closing member can be completely closed against the apparatus body.

23. The image forming apparatus according to claim 22, wherein when the belt unit is attached to the apparatus body, the moving member contacts the belt unit attached to the apparatus body when the opening and closing member is closed, and thereby the moving member moves from the first position or the second position.

24. The image forming apparatus according to claim 22, wherein the moving member rotates relative to the opening and closing member and thereby the moving member moves to the first position or the second position.

25. The image forming apparatus according to claim 22, wherein when the belt unit is attached to the apparatus body, the moving member is positioned at the second position, and the contact portion does not contact the apparatus body when the opening and closing member is closed.

* * * * *